US010450795B2

(12) United States Patent
Raffi et al.

(10) Patent No.: US 10,450,795 B2
(45) Date of Patent: Oct. 22, 2019

(54) SECURITY GATE

(71) Applicant: DOREL JUVENILE GROUP, INC., Foxboro, MA (US)

(72) Inventors: Laura Kay Raffi, Holliston, MA (US); Michael J. Smith, Arlington, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 89 days.

(21) Appl. No.: 15/573,191

(22) PCT Filed: May 17, 2016

(86) PCT No.: PCT/US2016/032842

§ 371 (c)(1),
(2) Date: Nov. 10, 2017

(87) PCT Pub. No.: WO2016/187185

PCT Pub. Date: Nov. 24, 2016

(65) Prior Publication Data

US 2018/0112457 A1 Apr. 26, 2018

Related U.S. Application Data

(60) Provisional application No. 62/162,963, filed on May 18, 2015.

(51) Int. Cl.

| | |
|---|---|
| ***E06B 3/68*** | (2006.01) |
| ***E06B 9/04*** | (2006.01) |
| ***E05B 65/00*** | (2006.01) |
| ***E05C 19/06*** | (2006.01) |
| *E06B 9/00* | (2006.01) |
| *E06B 9/01* | (2006.01) |
| *E05C 9/02* | (2006.01) |

(52) U.S. Cl.
CPC ..... *E06B 9/04* (2013.01); *E05B 65/0007* (2013.01); *E05C 19/06* (2013.01); *E05C 9/02* (2013.01); *E06B 2009/002* (2013.01); *E06B 2009/015* (2013.01)

(58) Field of Classification Search
CPC ..... E06B 9/04; E06B 2009/002; E06B 2009/015; E05C 19/06; E05C 9/02; E05B 65/0007
USPC ..... 49/50, 55, 57, 463, 465
See application file for complete search history.

(56) References Cited

U.S. PATENT DOCUMENTS

| | | | |
|---|---|---|---|
| 4,702,036 | A | 10/1987 | Johnson |
| 4,846,246 | A | 7/1989 | Stern |
| 5,052,461 | A | 10/1991 | Stern |
| 5,367,829 | A | 11/1994 | Crossley et al. |

(Continued)

OTHER PUBLICATIONS

Notice of Preliminary Rejection dated Feb. 25, 2019 for South Korean Patent Application No. 10-2017-7036210, filed May 17, 2016, 7 pages (English translation enclosed).

(Continued)

*Primary Examiner* — Jerry E Redman
(74) *Attorney, Agent, or Firm* — Barnes & Thornburg LLP

(57) ABSTRACT

A gate unit includes a gate mount and a gate coupled to the gate mount for swinging movement between opened and closed positions. A latch assembly is coupled to the gate to lock the gate in the closed position. The gate unit can be mounted in a doorway.

30 Claims, 18 Drawing Sheets

(56) References Cited

U.S. PATENT DOCUMENTS 5,797,218 A * 8/1998 Holland ..... E06B 9/04 49/55
5,829,505 A 11/1998 Rescia
5,924,242 A 7/1999 Macari et al.
6,112,461 A * 9/2000 Cheng ..... E06B 9/04 292/DIG. 12
6,176,042 B1 * 1/2001 Rossman ..... A01K 1/0017 160/210
6,253,490 B1 * 7/2001 Postans ..... E05B 65/0007 292/216
6,449,901 B1 9/2002 Gibree et al.
7,318,298 B2 1/2008 Marsden et al.
7,334,624 B2 * 2/2008 Waldman ..... E05B 17/2053 160/144
7,627,985 B2 * 12/2009 Marsden ..... E05B 65/0014 49/394
7,963,575 B2 * 6/2011 Mayo ..... E05B 65/0007 160/225
8,341,886 B2 * 1/2013 Yates ..... E05B 65/0007 204/468
8,733,017 B2 * 5/2014 Marsden ..... E05B 41/00 49/333
2007/0074453 A1 * 4/2007 Flannery ..... E06B 9/04 49/57
2009/0293363 A1 * 12/2009 Flannery ..... E06B 7/32 49/55
2011/0175046 A1 * 7/2011 Flannery ..... E06B 9/04 256/73
2012/0324792 A1 * 12/2012 Bertsch ..... E06B 9/04 49/37
2013/0160365 A1 * 6/2013 Flannery ..... E06B 9/04 49/50
2014/0373448 A1 12/2014 Henderson et al.
2015/0075079 A1 3/2015 Sundberg et al.
2015/0089873 A1 4/2015 Marsden et al.
2015/0101250 A1 * 4/2015 Marsden ..... E06B 9/0623 49/55
2015/0101253 A1 * 4/2015 Marsden ..... E05C 19/003 49/386
2015/0267463 A1 * 9/2015 Yager Grad ..... E06B 9/06 49/465
2017/0211314 A1 * 7/2017 Raffi ..... E06B 9/04

OTHER PUBLICATIONS

PCT Search Report and Written Opinion completed by the ISA/US on Jul. 7, 2016 and issued in connection with PCT/US2016/032842.

* cited by examiner

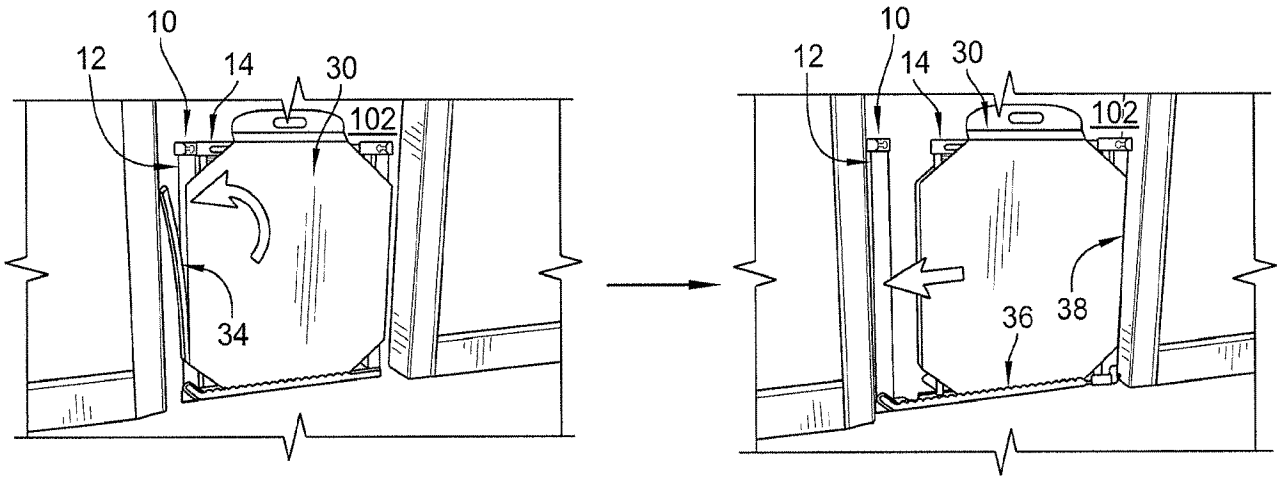
FIG. 25A
FIG. 25B
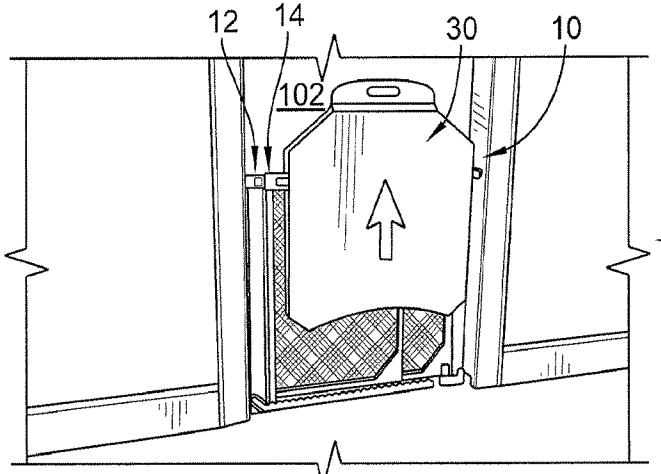
FIG. 25C

SECURITY GATE

CROSS-REFRENCE TO RELATED APPLICATIONS

This application is a national stage entry under 35 USC § of PCT International Application No. PCT/US2016/032842, filed May 17, 2016, and claims the benefit to U.S. Provisional Patent Application No. 62/162,963, filed May 18, 2015, the disclosures of both of which are expressly incorporated by reference in their entirety.

BACKGROUND

The present disclosure relates to movable barriers, and particularly to security gates. More particularly, the present disclosure relates to a variable-width security gate for use in a doorway inside a dwelling.

SUMMARY

A gate unit in accordance with the present disclosure includes a gate that can be moved in a doorway about a pivot axis by a person between closed and opened positions. In the closed position, the gate is arranged to block movement through the doorway.

In illustrative embodiments, the gate unit includes a pivotable gate and a gate mount that is adapted to mate with a post-support frame bordering a doorway in an interroom environment between two rooms or a gateway in a top-of-the-stairs environment at the top of a staircase. The gate mount includes laterally spaced apart vertical side posts and a threshold bar. The threshold bar is arranged to extend between and interconnect the vertical side posts and normally lie on or along the floor when the gate mount is placed in a doorway in an interroom environment. The gate is mounted on one of the side posts for pivotable movement between opened and closed positions. When closed, the gate can be retained in the closed position using a latch that engages the other side post.

In illustrative embodiments, the gate unit in accordance with the present disclosure is configured to include a threshold bar that is removable in the field so that the gate unit can be used by a consumer (1) in a doorway in an interroom environment in which the threshold bar is arranged to extend along the floor between spaced-apart door jambs included in a door frame associated with the doorway, and, alternatively (2) in a gateway in a top-of-the-stairs environment in which the threshold bar is removed by the consumer and stored so that it does not extend along the floor when the gate unit is in use. In accordance with the present disclosure, the removed threshold bar can be stored by the consumer in one or more bar storage spaces formed in the vertical side posts of the gate mount so that it is retained for future use if the gate unit is moved later from the top-of-the-stairs environment to an interroom environment.

In illustrative embodiments, each vertical side post has a first end and an opposite second end. The threshold bar can be arranged to extend horizontally between the side posts and coupled temporarily to the first end of each side post to provide a U-shaped gate mount. The threshold bar is configured to be removable by a consumer so that the gate unit can be used at the top of a staircase. The threshold bar can be separated from the side posts by a consumer in accordance with the present disclosure while other portions of the gate mount are anchored in stationary positions at, for example, the top of a staircase.

In illustrative embodiments, the gate unit can be changed in the field by a consumer to convert the gate unit from a pressure-mounted mode to a hardware-mounted mode using a process in accordance with the present disclosure that involves removal of the threshold bar. In each mode, the U-shaped gate mount will be placed in its designated location (e.g. in an interroom environment or a top-of-the-stairs environment) while the removable threshold bar remains coupled to the first ends of the side posts. In the pressure-mounted mode in a doorway in an interroom environment (or in a hallway), the U-shaped gate mount is oriented to assume an upright orientation so that the threshold bar normally is arranged to extend along the floor and lie under the pivotable gate. In an alternative hardware-mounted mode in a gateway in a top-of-the-stairs environment, the U-shaped gate mount is inverted to assume an inverted orientation by the consumer so that it appears to be upside down before the gate unit is installed to cause the threshold bar to lie above the pivotable gate, and then after the post-anchoring hardware is coupled to a neighboring post-support frame associated with the gateway, the elevated threshold bar is separated from the first ends of the side posts by the consumer and removed so that someone may pass through the opened gate. The removable threshold bar is then stowed by the consumer in bar-storage space provided in one or both of the vertical side posts. The threshold bar can be removed easily by a consumer without removing the hardware-anchored side posts form the adjacent post-support frame in a top-of-the-stairs environment.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 2A is a front perspective view of the gate unit of FIG. 1 after it has been removed from the doorway in the interroom environment of FIG. 1, rotated 180° about a phantom horizontal gate-inversion axis line (as suggested by the double arrow) to assume an inverted orientation, and then mounted in a gateway associated with a staircase in a top-of-the-stairs environment to lie in the inverted orientation and showing that the removable threshold bar is now arranged to extend in a horizontal direction above the closed gate and away from a portion of the floor under the closed gate;

FIG. 2B is a view similar to FIG. 2A after the removable threshold bar has been separated from the rest of the gate unit by a consumer while the vertical side posts of the gate unit remain mounted to the post-support frame in the gateway in the top-of-the-stairs environment so that the threshold bar no longer serves as a stationary horizontally extending barrier to block passage of a person through a walkway passage defined by the gate mount and associated with the gateway after the gate is pivoted to an opened position and showing that first and second bar segments of the threshold bar have been separated from one another by the consumer so that the first bar segment can be inserted by the consumer downwardly into a vertical first bar-segment storage space that is aligned with or formed in a vertical lock-side post included in the U-shaped gate mount and so that the second bar segment can be inserted by the consumer downwardly into a vertical second bar-segment storage space that is aligned with or formed in a vertical hinge-side post;

FIG. 2C is a view similar to FIG. 2B showing that the first bar segment has been stowed in the first bar-segment storage space provided to the left of the closed gate and that the second bar segment has been stowed in the second bar-segment storage space provided to the right of the closed gate and suggesting that removal of the threshold bar from the top of the gate unit has cleared a path through the walkway passage associated with the gateway once the gate is pivoted to an opened position;

FIGS. 25A-C illustrate a method in accordance with the present disclosure for removing packaging from the gate unit during installation of the gate unit in a doorway;

DETAILED DESCRIPTION

Figure 1:
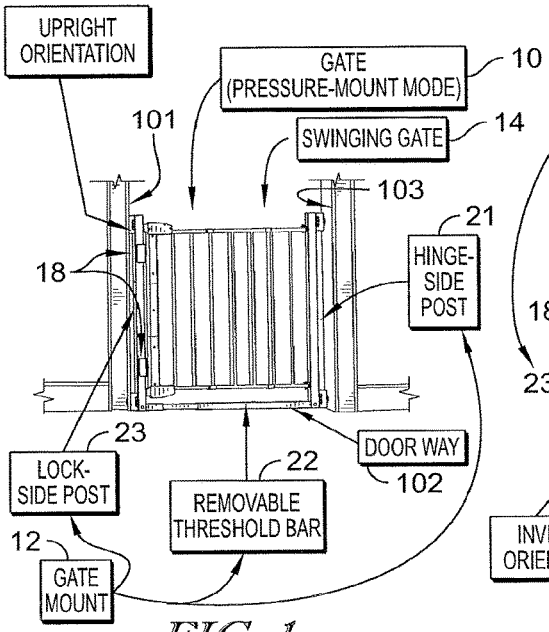
FIG. 1 is a front perspective view of a gate unit in accordance with the present disclosure placed in a doorway in an interroom environment between two rooms in a dwelling and showing that the gate unit is anchored in an upright orientation in the doorway and includes (1) a U-shaped gate mount having a removable threshold bar and mating with a door frame bordering the doorway in a pressure-mounted mode and (2) a gate mounted on the U-shaped gate mount for swinging movement about a vertical pivot axis between a closed position and an opened position and showing that the removable threshold bar of the U-shaped gate mount is arranged to extend along the floor in the doorway below and under the gate when the gate unit is anchored in the upright orientation in the doorway.
Figure 2A:
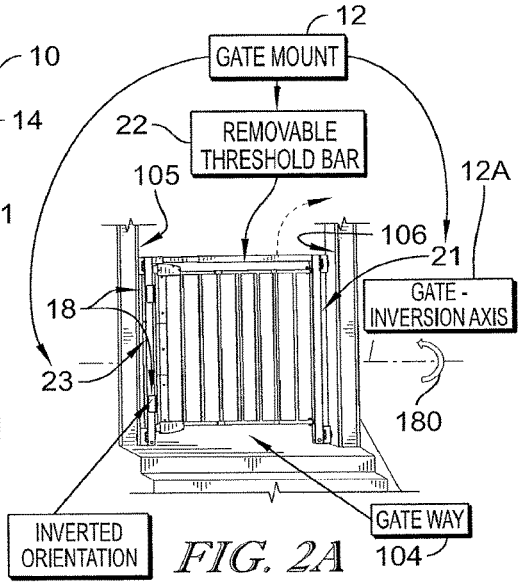
FIGS. 2A-2C illustrate a process in accordance with the present disclosure as to how the gate unit can be changed in the field by a consumer from a pressure-mounted mode in a doorway in an interroom environment as shown in FIG. 1 to a hardware-mounted mode at the top of a staircase in a top-of-the-stairs environment as shown in FIG. 2C by: (1) inverting the gate unit to cause the removable threshold bar to lie above the pivotable gate as shown in FIG. 2A rather than below the pivotable gate as shown in FIG. 1, (2) removing the threshold bar from the rest of the gate unit while the vertical side posts are anchored to the adjacent post-support frame of a gateway and separating the two bar segments included in the removable threshold bar as shown in FIG. 2B, and (3) stowing each of the bar segments in a companion bar-segment storage space formed in the vertical side posts included in the gate mount as shown in FIG. 2C.
Figure 2B:
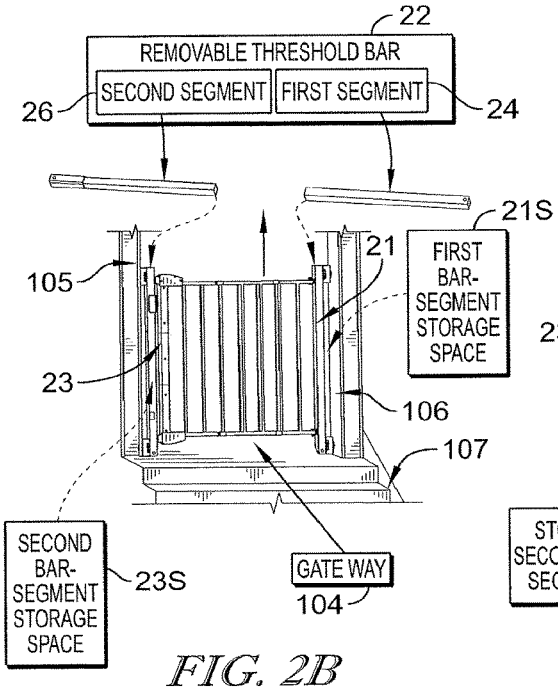
Figure 2C:
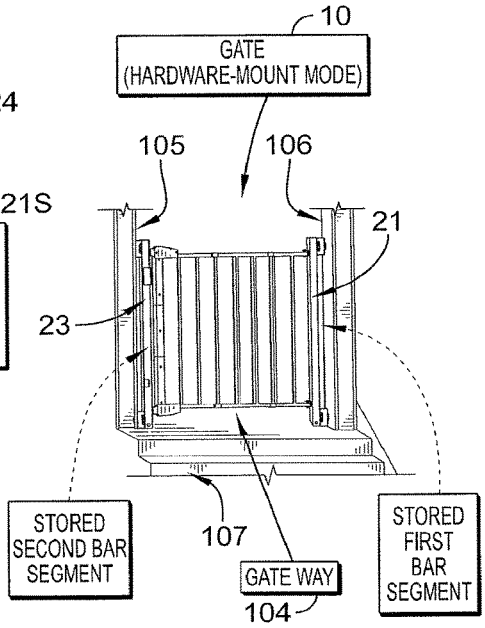

A gate unit 10 in accordance with the present disclosure is configured for use in a pressure-mounted mode in a doorway 102 in an interroom environment, as suggested in FIG. 1, and a hardware-mounted mode in a gateway 104 in a top-of-the-stairs environment, as suggested in FIG. 2C. It is within the scope of the present disclosure also to use the gate unit 10 in a hardware-mounted mode in a doorway in an interroom environment.

Figure 19:
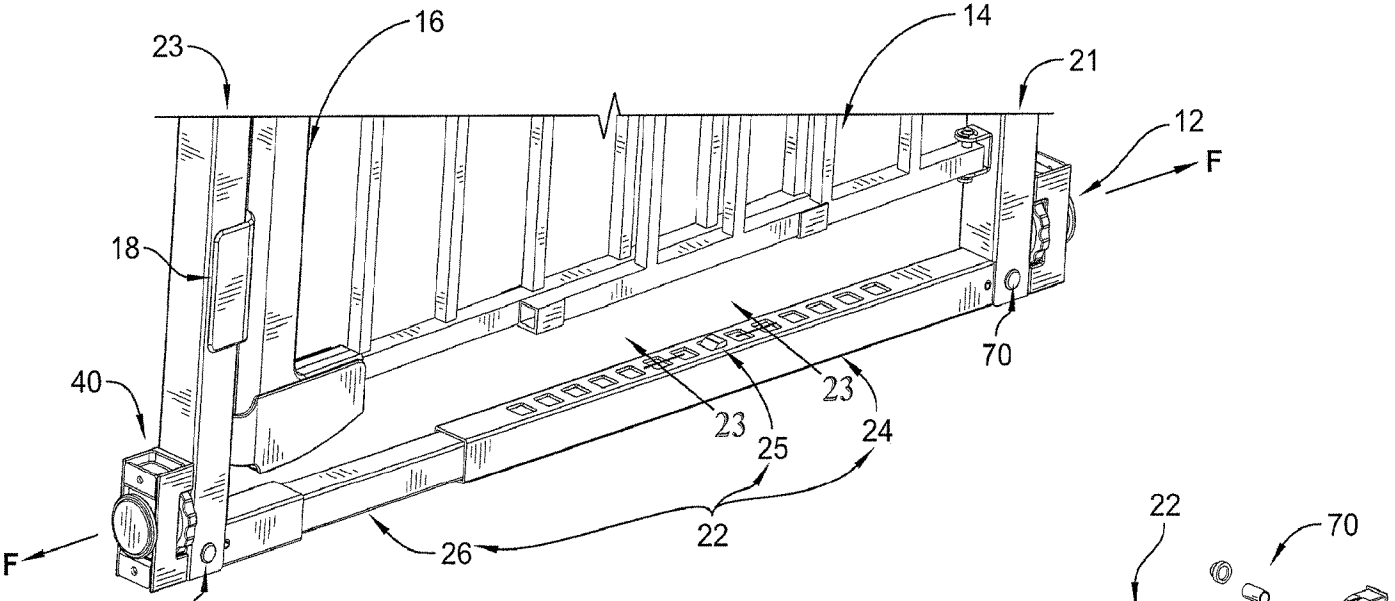
FIG. 19 is an enlarged perspective view of the removable threshold bar of FIGS. 1-4.
Figure 20:
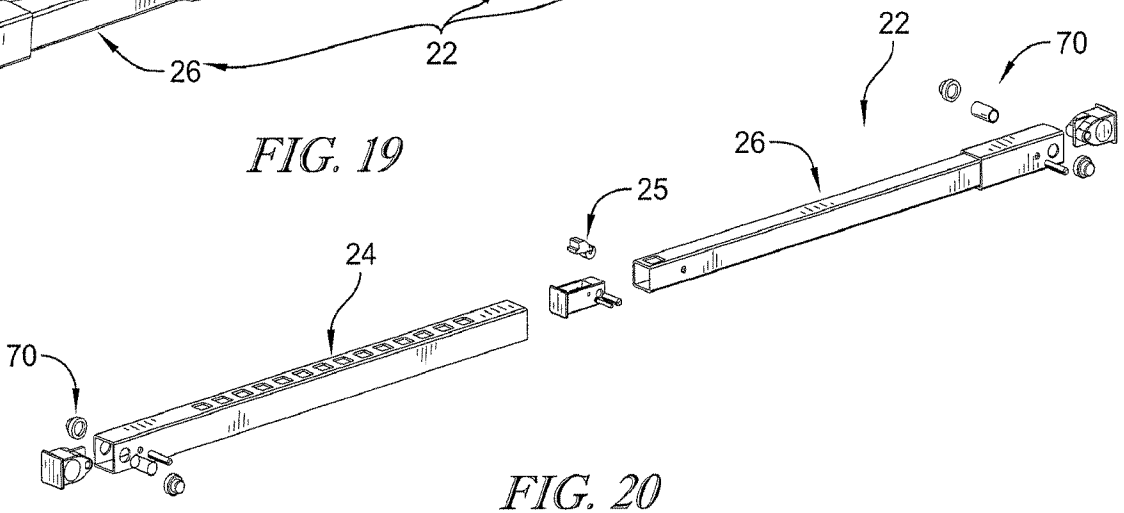
FIG. 20 is an enlarged exploded perspective assembly view of the removable threshold bar of FIG. 19.

Gate unit 10 includes a U-shaped gate mount 12 having a removable threshold bar 22 that is arranged to provide outward force F against a post-support frame 101, 103 in the pressure-mounted mode, as suggested in FIGS. 1, 19, and 20 and a pivotable gate 14 having a latch assembly 16 for locking gate 14 in a closed position, as suggested in FIGS. 6-9. Once threshold bar 22 is removed to ready the gate unit 10 for use in a gateway 104 in the top-of-the-stairs environment, the consumer can separate bar segments 24, 26 included in the removed threshold bar 22 and stow those segments 24, 26 as suggested in FIGS. 24A-E. Gate unit 10 is wrapped in packaging 30 having indicia 32 showing a consumer how to install gate unit 10 in a doorway 102 or in a gateway 104 associated with a staircase as suggested in FIGS. 25A-28J. A process in accordance with the present disclosure for orienting and modifying the gate unit 10 in the field at the option of a consumer so that gate unit 10 can be used in hardware-mounted mode in a gateway 104 in a top-of-the-stairs environment is illustrated in FIGS. 2A-2C.

A gate unit 10 is provided for use in a dwelling as suggested in FIGS. 1 and 2A-2C. Gate unit 10 includes a gate mount 12 adapted to be mounted to a portion (e.g., 101, 103 and 105, 106) of the dwelling and a gate 14 mounted on a portion of the gate mount 12 for swinging movement about a gate-pivot axis 14A between an opened position and a closed position.

Figure 3:
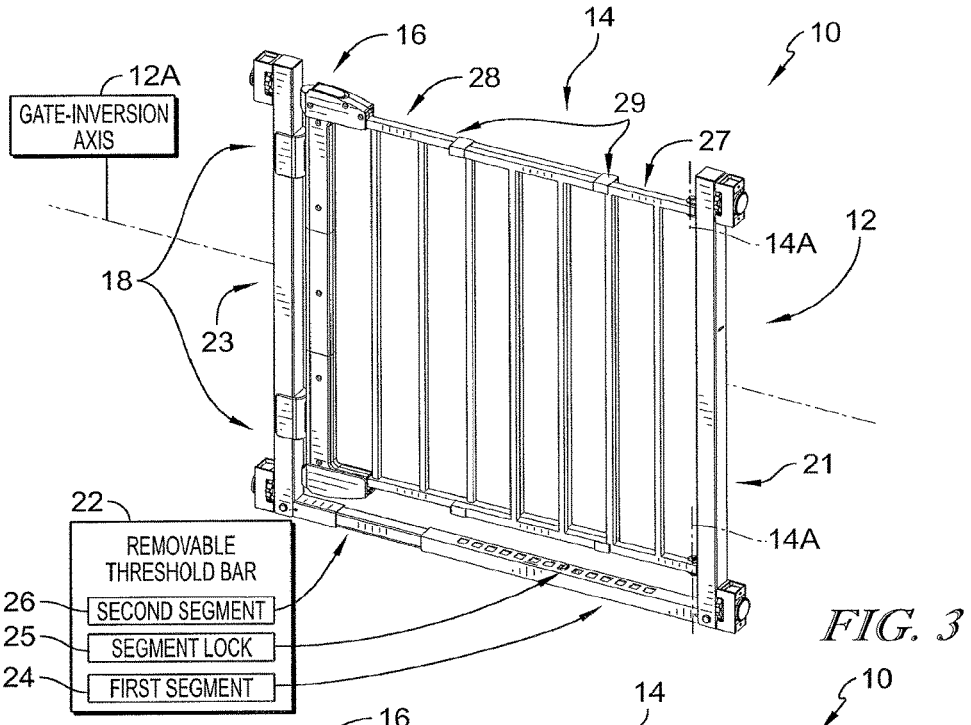
FIG. 3 is a perspective view of the gate unit shown in the upright orientation of FIG. 1 to place the removable threshold bar below the swinging gate and showing that the removable threshold bar includes two segments that are interconnected for relative slidable movement and a segment lock (shown in more detail in FIGS. 19-22) and showing that retention feet are coupled to the outer edges of each of the vertical side posts of the U-shaped gate mount to apply pressure between the post-support frame of the doorway and the gate mount in the pressure-mounted mode.

Gate mount 12 includes laterally spaced apart vertical side posts 21, 23 and a horizontally extending removable threshold bar 22 that is coupled to the vertical side posts 21, 23 and arranged normally to interconnect first ends of each of the vertical side posts 21, 23 to provide the gate mount with a U-shape as suggested in FIG. 3. Gate mount 12 is adapted to be mounted to the portion of the dwelling in a pressure-mounted mode as suggested in FIG. 1 while the threshold bar 22 remains coupled to the vertical side posts 21, 23 using pads 42 that are held under pressure to the portion 101, 103 of the dwelling or in a hardware-mounted mode as suggested in FIGS. 2A-2C using hardware that is anchored to the portion 105, 106 of the dwelling after threshold bar 22 has been decoupled from the vertical side posts 21, 23. Gate mount 12 is arranged to assume an upright orientation as suggested in FIG. 1 to cause threshold bar 22 to lie below gate 14 and along a floor underlying gate 14 when gate unit 12 is placed in a doorway 102 in an interroom environment in the pressure-mounted mode. Gate mount 12 is arranged to assume an inverted orientation as suggested in FIG. 2A to cause the threshold bar to lie above gate 14 and in spaced-apart relation to the floor underlying gate 14 to position gate 14 to lie between threshold bar 22 and the floor when gate unit 10 is placed in a gateway 104 associated with a staircase in a top-of-the-stairs environment.

Gate mount 12 further includes bar-removal means 70 for coupling and uncoupling threshold bar 22 to and from the vertical side posts 21, 23 so that gate mount 112 is retained in the upright orientation in the doorway 102 in the interroom environment in the pressure-mounted mode while threshold bar 22 is coupled to the vertical side posts 21, 23 and arranged to extend along the floor and gate mount 12 is retained in the inverted orientation in gateway 104 in the top-of-the-stairs environment in the hardware-mounted mode before and after decoupling of threshold bar 22 from vertical side posts 21, 23. Bar-removal means 70 comprises a pinch lock 70 at each end of threshold bar 20 in an illustrative embodiment as suggested in FIGS. 19 and 20.

Threshold bar 22 includes a first segment 24, a second segment 26 mounted for movement relative to first segment 24 and to be separated from first segment 24, and a segment lock 25 configured to block relative movement of first and second segments 24, 26 as suggested in FIGS. 19 and 20. First vertical side post 21 is formed to include a first bar-segment storage space 21S sized to receive therein the first segment 24 after threshold bar 22 has been decoupled from the vertical side posts 21, 23 and first segment 24 has been separated from second segment 26 as suggested in FIG. 2B. Second vertical side post 23 is formed to include a second bar-segment storage space 23S sized to receive therein the second segment 26 after threshold bar 22 has been decoupled from the vertical side posts 21, 23 and first segment 24 has been separated from second segment 26 as suggested in FIG. 2B. First segment 24 is arranged to lie in the bar-storage space 21S formed in the first vertical side post 21 and second segment 26 is arranged to lie in the bar-storage space 23S formed in the second vertical side post 23 when the gate mount 12 is retained in the inverted orientation in the gateway 104 in the top-of-the-stairs environment as suggested in FIG. 2C. In illustrative embodiments, first bar-segment storage space 21S is formed in an interior region of the first vertical side post 21 and the second bar-segment storage space 23S is formed in an interior region of the second vertical side post 23.

Gate mount 12 includes a removable threshold bar 22, a hinge side post 21, and a lock side post 23 as shown in FIG. 1. In the pressure-mounted mode in an interroom environment, gate unit 10 is positioned to lie within a doorway 102 provided between two rooms of a dwelling that have substantially even floor levels or in a hallway between two rooms. Gate mount 12 engages with opposing door jambs 101, 103 of doorway 102. Removable threshold bar 22 is positioned below gate 14 and configured to provide an outward force against the door jambs 101, 103 to hold gate unit 10 within doorway 102.

In the hardware-mounted mode in a top-of-the-stairs environment, gate unit 10 is positioned to lie within a gateway 104 at the top of a set of stairs 107 in the dwelling as suggested in FIG. 2. Gate mount 12 is secured to opposing jambs 105, 106 of gateway 104 with the use of hardware fasteners to maintain gate unit 10 in a stationary position within gateway 104. Removable threshold bar 22 is positioned above gate 14 and is configured to be removed and stored within storage spaces 21S, 23S formed in vertical side posts 21, 23 to open a path through gate unit 10 as suggested in FIGS. 24A-E. In some embodiments, gate unit 10 is used in the hardware-mounted mode in doorway 102 in an interroom environment.

A latch assembly 16 is coupled to pivotable gate 12 to swing with gate 12 and is configured to engage with latch receivers 18 to lock gate 14 in a closed position as suggested in FIGS. 1 and 2. As suggested in FIGS. 1 and 2, gate unit 10 is flipped (e.g. rotated 180°) about a horizontal gate-inversion axis 12A between the pressure-mounted mode and the hardware-mounted mode. Latch assembly 16 is substantially symmetrical across horizontal gate-inversion axis 12A to allow unlocking of gate 14 and operation of gate unit 10 in the pressure-mounted and hardware-mounted modes as suggested in FIGS. 3 and 4.

Figure 4:
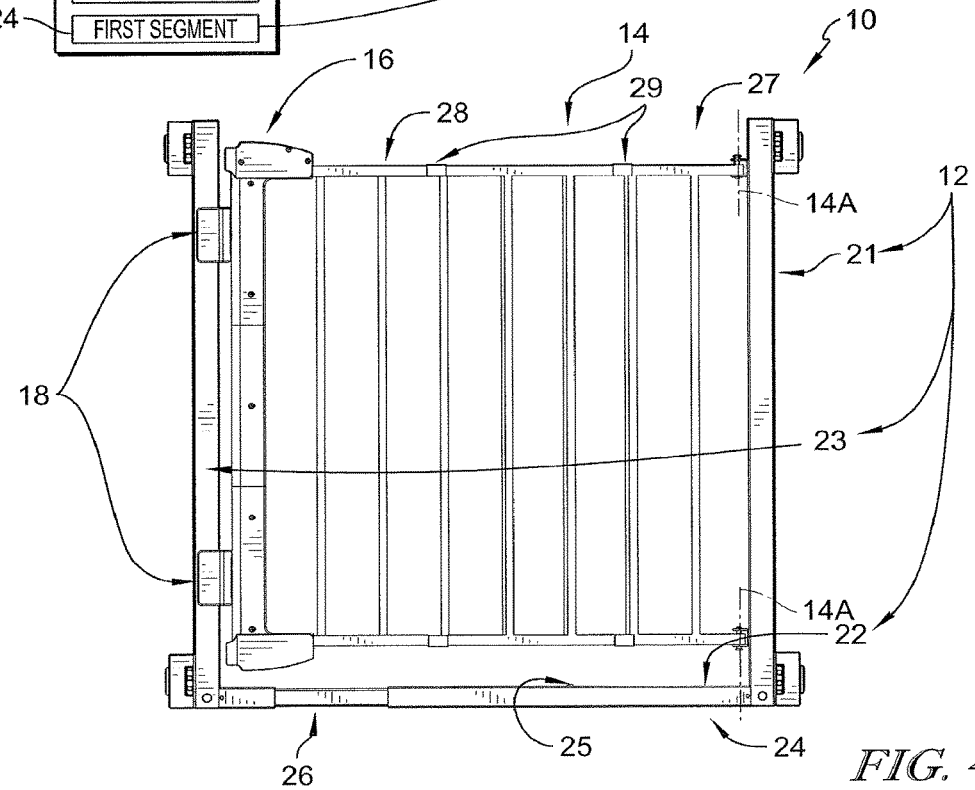
FIG. 4 is a front elevation view of the gate unit of FIG. 3 showing that a latch assembly is carried on the left side of the gate to engage with latch receivers coupled to the left side vertical side of the gate mount to lock the gate in the closed position as suggested in FIGS. 6-10.

Removable threshold bar 22 includes a first bar segment 24 and a second bar segment 26 received within and slidable relative to first bar segment 24 as suggested in FIGS. 3 and 4. A bar segment lock 25 is coupled between bar segments 24, 26 and configured to provide means for selectively locking first bar segment 24 to second bar segment 26 to allow relative movement of vertical side posts 21, 23 so the width of gate mount 12 can be varied at the option of a consumer. Gate 14 includes a hinge panel 27 coupled to hinge side post 21 and a lock panel 28 coupled to hinge panel 27. Lock panel 28 is slidable relative to hinge panel 27 and gate 14 includes a panel lock 29 to maintain position of lock panel 28 relative to hinge panel 27 at the selection of a user.

Figure 5:
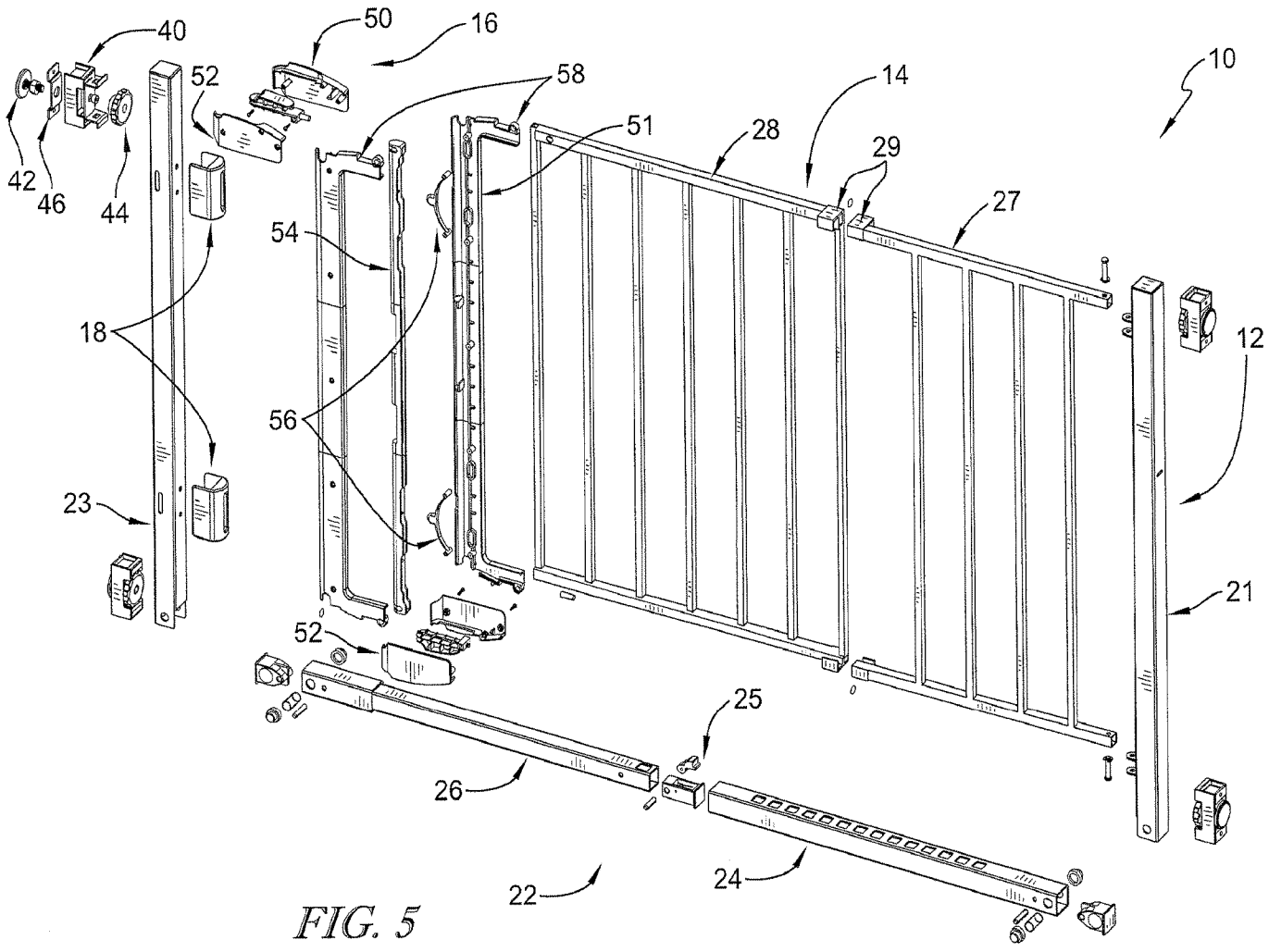
FIG. 5 is an exploded perspective assembly view of the gate unit of FIGS. 1-4 showing that the U-shaped gate mount includes a removable threshold bar comprising a left bar segment and a separate right bar segment, a vertical left side post for mating with the left end of the left bar segment, and a vertical right side post for mating with the right end of the right bar segment.
Figure 7:
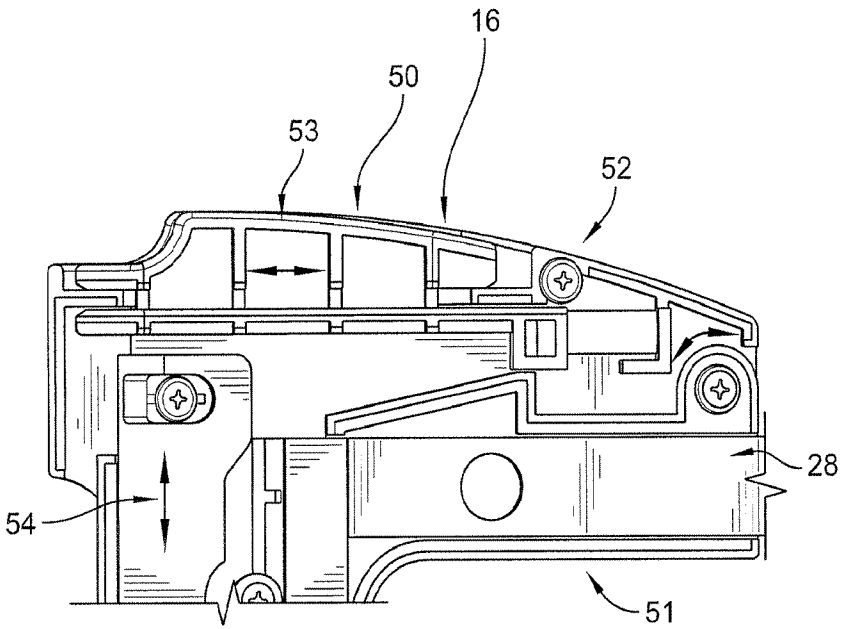
FIG. 7 is an enlarged view of the handle shown in FIG. 6 with portions broken away to show the handle pivots relative to the latch base to move the latch retractor bar and that a trigger is positioned to block pivoting movement of the handle until a user slides the trigger relative to the handle.
Figure 6:
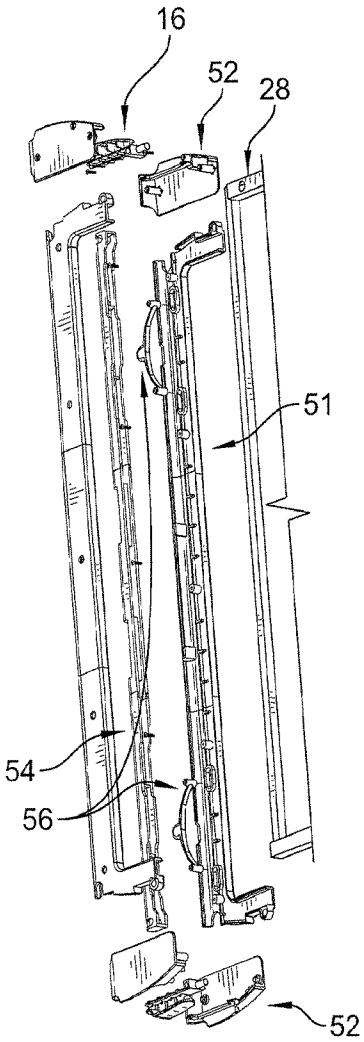
FIG. 6 is an enlarged exploded perspective assembly view of the latch assembly of FIG. 4 showing that the latch assembly includes a pair of handles configured to move a latch retractor bar coupled between the handles and a pair of latches positioned within a latch base for movement between a locked position and an unlocked position.

Latch assembly 16 includes a latch mover 50 and latches 56 coupled to latch mover 50 as suggested in FIG. 5. Latch mover 50 includes handles 52 and a latch retractor bar 54 coupled between handles 52 and positioned to engage with latches 56. Latches 56 and latch retractor bar 54 are housed within a latch base 51 coupled to gate 14. Handles 52 pivot relative to latch base 51 to move latch retractor bar 54 in a vertical direction. A trigger 53 is coupled within handle 52 to block rotation of handle 52. A user slides trigger 53 relative to handle 52 to allow downward rotation of handle 52 as suggested in FIG. 7.

Figure 9:
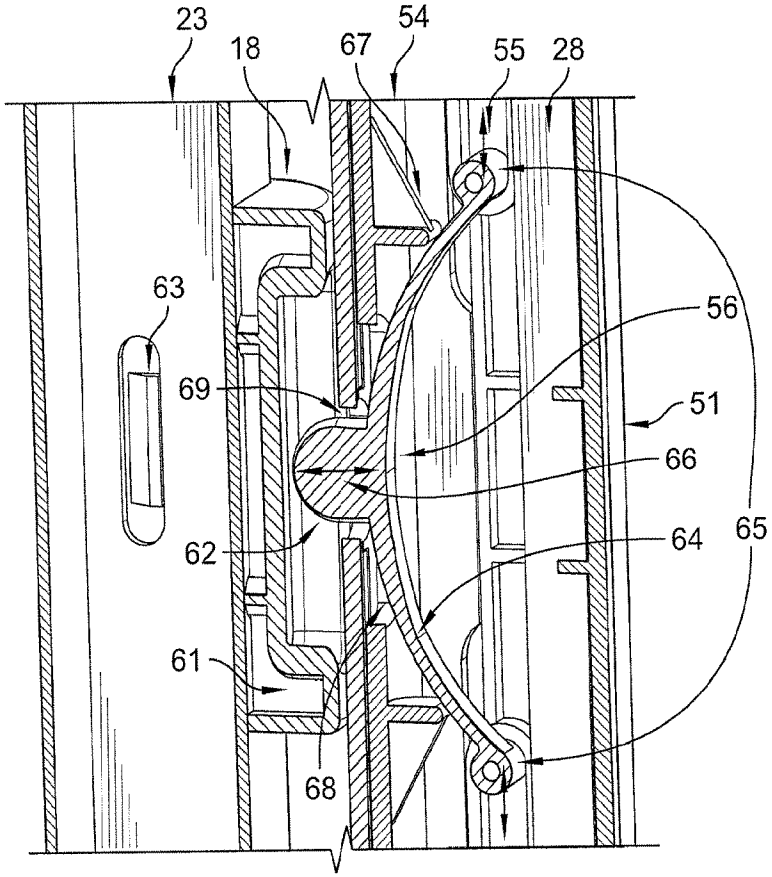
FIG. 9 is a perspective sectional view taken along line 9-9 in FIG. 8 showing the latch in a locked positon and that each latch includes a pair of pins positioned to move in slots of the latch base, a leaf spring coupled between the pins and configured to bias the pins toward one another, and a lock tab coupled to the leaf spring and arranged to extend through the latch retractor bar and latch base to engage the latch receiver and suggesting that the latch retractor bar engages with the leaf springs of the latches to retract the lock tab from the latch receiver toward the unlocked position.
Figure 8:
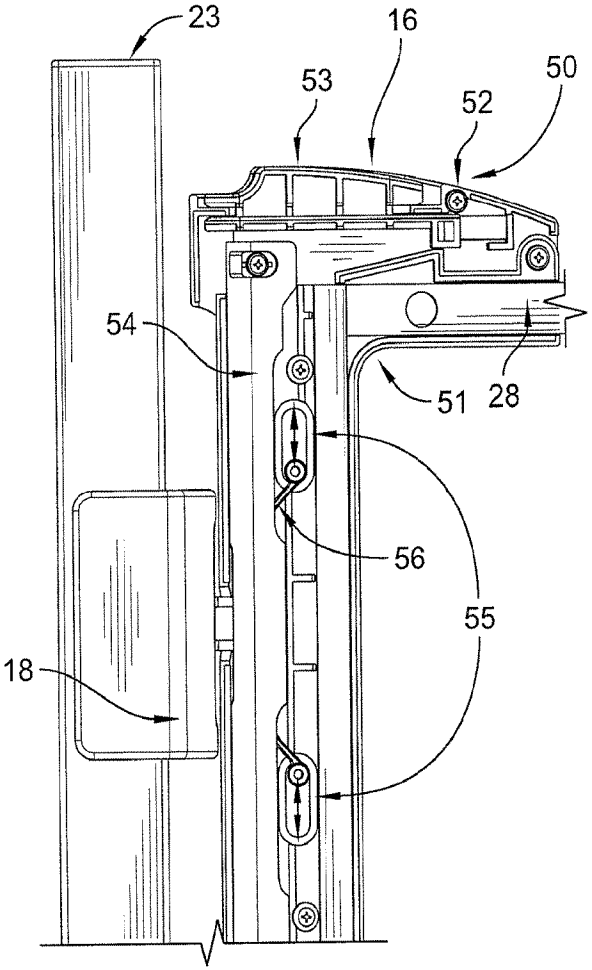
FIG. 8 is a view similar to FIG. 7 showing that the latch retractor bar is coupled to the handle for vertical motion relative to the latch base when moved by the handle.

Latch retractor bar 54 engages with latches 56 such that vertical movement of latch retractor bar 54 causes movement of latch 56 to disengage latch 56 from latch receiver 18 as suggested in FIGS. 8 and 9. Each latch receiver 18 includes a body 61 and a retainer clip 63 coupled to body 61 as shown in FIG. 9. Retainer clip 63 engages with side post 23 to retain latch receiver 18 on side post 23. Body 61 is formed to include a recess 62.

Each latch 56 includes a pair of pins 65, a leaf spring 64 coupled between pins 65, and a lock tab 66 coupled to leaf spring 64. Pins 65 ride in slots 55 formed in latch base 51. Lock tab 66 is coupled to leaf spring 64 substantially at an apex of leaf spring 64 to extend into recess 62 of latch receiver 18. Latch retractor bar 54 and latch base 51 are formed to include apertures 68, 69, respectively, to allow lock tab 66 to pass through latch retractor bar 54 and latch base 51. Leaf spring 64 biases pins 65 toward one another to force lock tab 66 into recess 62.

Latch retractor bar 54 includes a pair of latch actuators 67 positioned to engage with leaf spring 66 to move latch 56 between the locked position, as shown in FIG. 9, and the unlocked positioned wherein lock tab 66 is retracted from recess 62 and clear of latch receiver 18. For example, downward vertical movement of latch retractor bar 54 causes upper latch actuator 67 to engage with leaf spring 66. Lower pin 65 is forced downward in slot 55 increasing a distance between upper and lower pins 65 and reducing a lateral height of leaf spring 64 to retract lock tab 66 laterally from recess 62.

Figure 11:
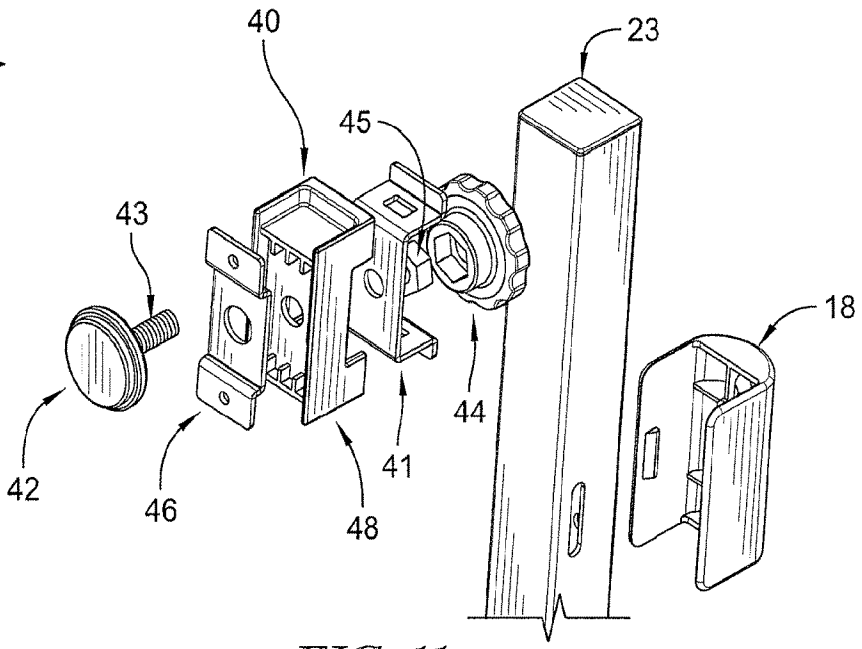
FIG. 11 is an enlarged exploded perspective assembly view of the retention feet of FIG. 10 showing that each of the retention feet includes an extendable pad coupled to a knob for extending the pad and a bracket coupled between the pad and the knob and suggesting that the pad engages the post-support frame of the doorway in the pressure-mounted mode and the bracket is secured to post-support frame of the doorway in the hardware-mounted mode.
Figure 10:
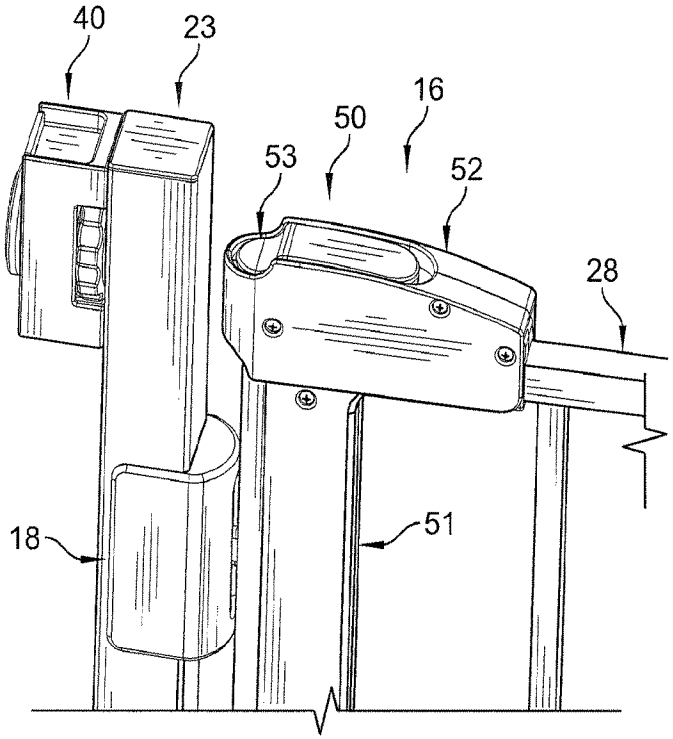
FIG. 10 is an enlarged perspective view of the gate unit of FIGS. 1-4 showing that the retention feet are coupled to the vertical side posts to face outwardly away from the gate.
Figure 12:
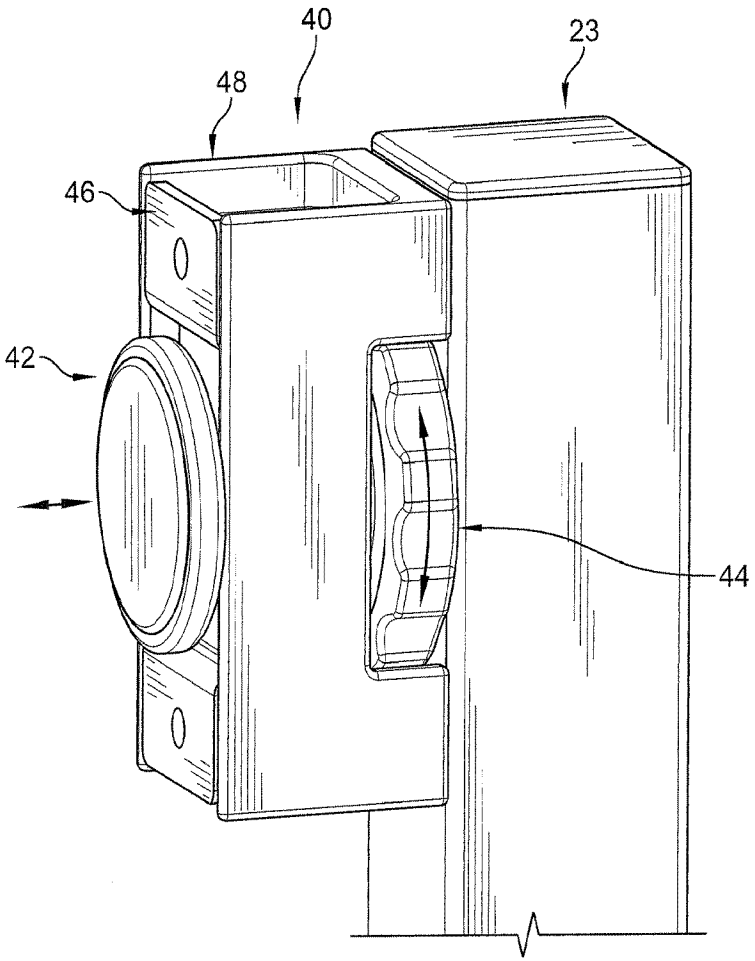
FIG. 12 is an enlarged perspective view of the retention foot of FIG. 10.

Retention feet 40 are coupled to vertical side posts 21, 23 of gate mount 12 as shown in FIGS. 5 and 10. Each retention foot 40 includes an extendable engagement pad 42, a knob 44, and a bracket 46 coupled between pad 42 and knob 44 as shown in FIG. 11. A coupler 41 is configured to extend over knob 44 and couple with vertical side posts 21, 23. A housing 48 engages with coupler 41 and is configured to receive bracket 46 as shown in FIGS. 12 and 13.

Figure 13:
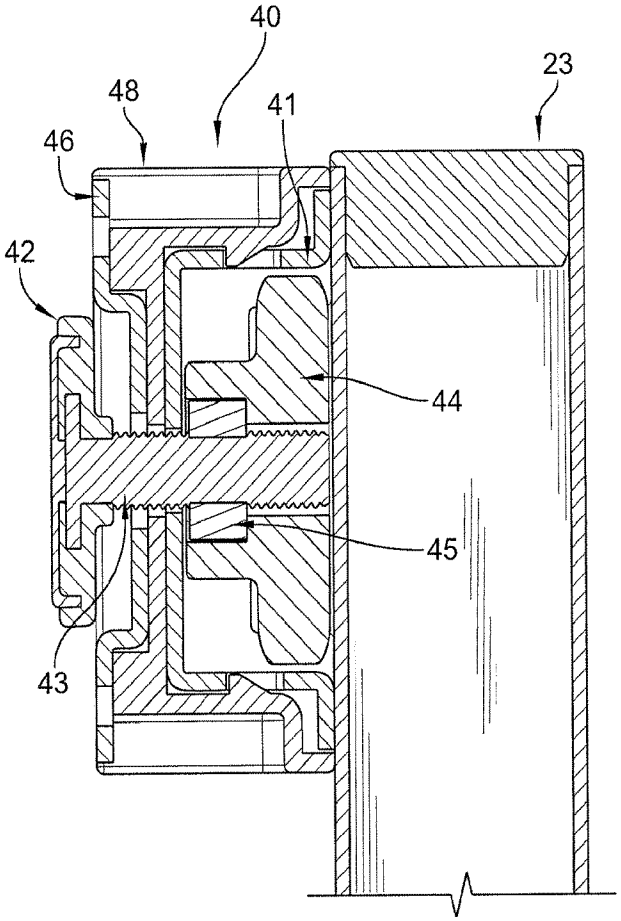
FIG. 13 is a sectional view taken along line 13-13 in FIG. 12.
Figure 16:
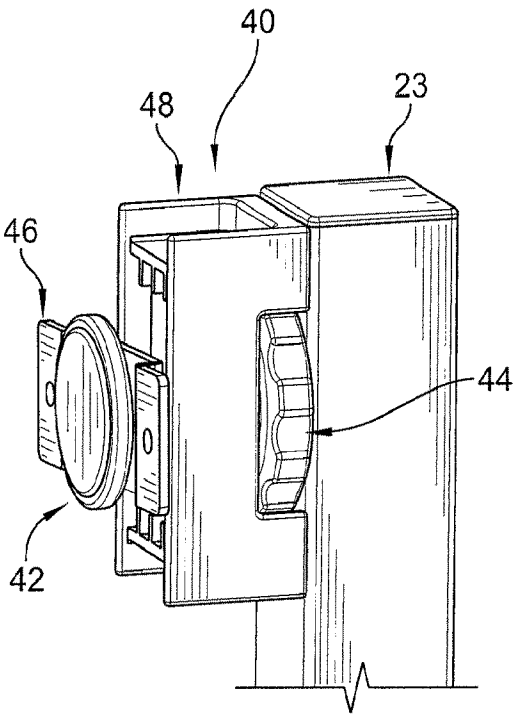
FIG. 16 is a view similar to FIG. 12 showing the bracket rotated relative to the housing to secure the bracket to the post-support frame of the doorway in the hardware-mounted mode.
Figure 15:
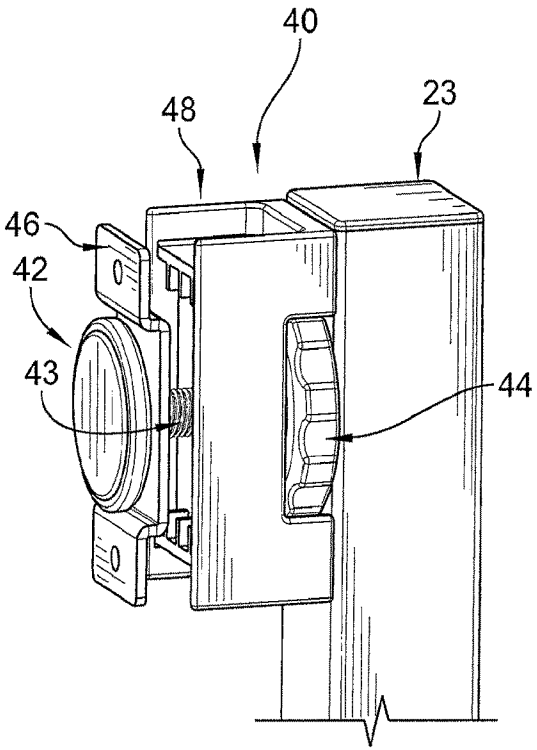
FIG. 15 is a view similar to FIG. 14 showing the bracket removed from a housing of the retention foot.
Figure 14:
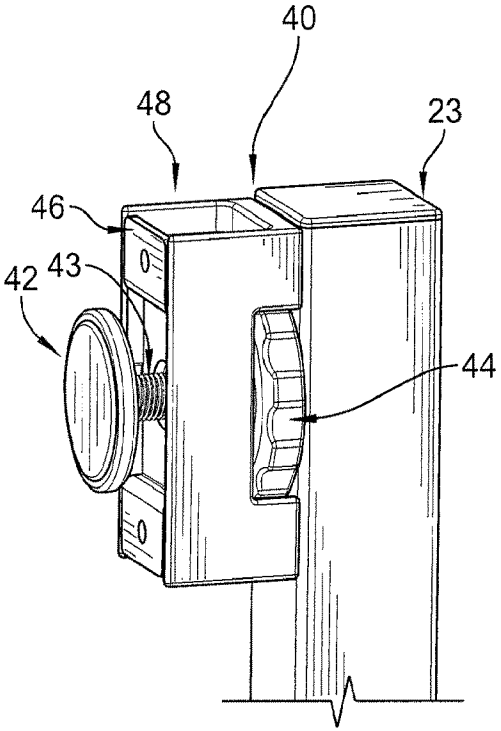
FIG. 14 is a view similar to FIG. 12 showing the pad extended.

Pad 42 is coupled to a threaded shaft 43 as shown in FIG. 13. Shaft 43 extends through bracket 46, housing 48, and coupler 41 to engage with a nut 45. Knob 44 is configured to extend and retract pad 42 by rotating nut 45 as suggested in FIG. 12. Bracket 46 is configured to receive fasteners for securing gate mount 12 within doorway 102 and gateway 104. For example, pad 42 is extended by rotating knob 44 as suggested in FIG. 14. Bracket 46 is removed from housing 48 to engage with pad 42 as suggested in FIG. 15. Bracket 46 is rotated about shaft 43 as suggested in FIG. 16. Fasteners are used to secure bracket 46 in doorway 102 and gateway 104. Pad 42 retains bracket 46 to vertical side posts 21, 23 of gate mount 12.

Figures 17, 18:
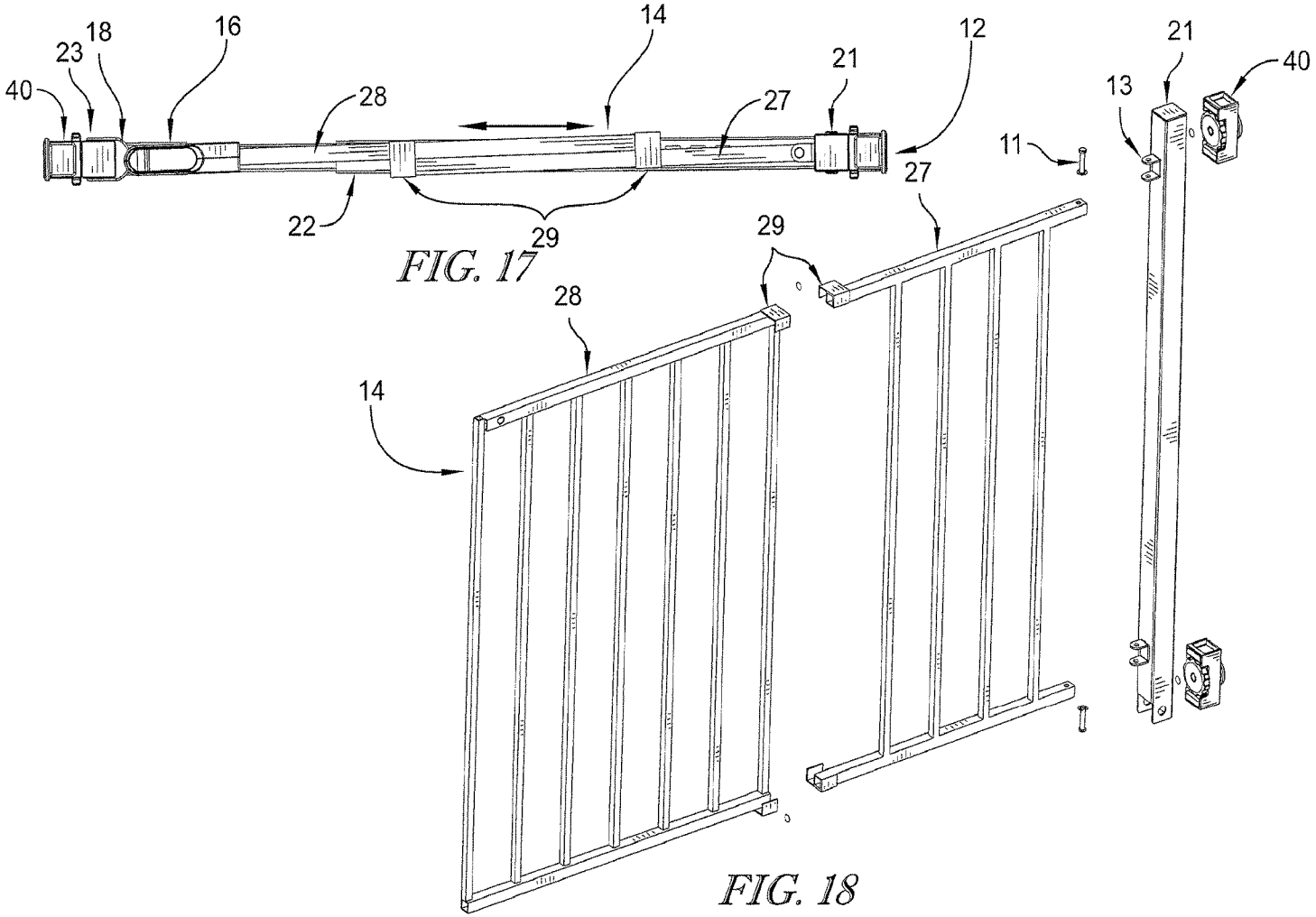
FIG. 17 is a top plan view of the gate unit of FIGS. 1-4.
FIG. 18 is an enlarged exploded perspective assembly view of the gate.

Lock panel 28 is slidable relative to hinge panel 27 to position latch assembly 16 relative to latch receivers 18 as suggested in FIG. 17. Lock panel 28 is coupled to hinge panel 27 by panel lock 29 as suggested in FIG. 18. In some embodiments, hinge lock 29 is a clamp. In other embodiments, hinge lock 29 is a clip. Hinge side post 21 includes hinge brackets 13 for coupling gate 14 to hinge side post 21. Hinge pins 11 couple gate 14 with hinge brackets 13 to allow swinging movement of gate 14 relative to gate mount 12.

Figure 21:
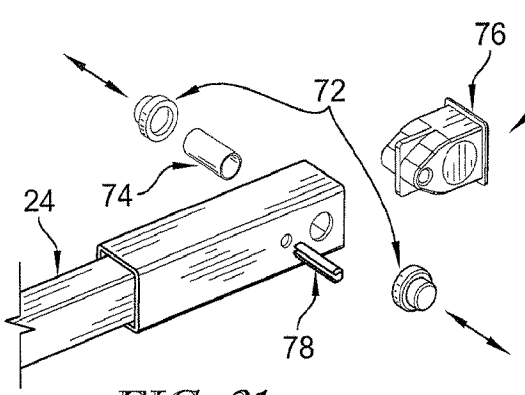
FIG. 21 is an enlarged exploded perspective assembly view of a pinch lock configured to attach the removable threshold bar to the companion vertical side posts.

Removable threshold bar 22 is coupled to vertical side posts 21, 23 by pinch locks 70 as suggested in FIGS. 19 and 20. Each pinch lock 70 includes a pair of buttons 72 and a spring 74 positioned between buttons 72 as shown in FIG. 21. Spring 74 biases buttons 72 away from one another. Buttons 72 and spring 74 are positioned within an end cap 76 coupled to bar segments 24, 26 and secured with a retention pin 78. Buttons 72 at least partially extend through bar segments 24, 26 to engage with vertical side posts 21, 23 to couple removable threshold bar 22 to vertical side posts 21, 23. A user biases buttons 72 toward one another to release threshold bar 22 from vertical side posts 21, 23.

Figure 22:
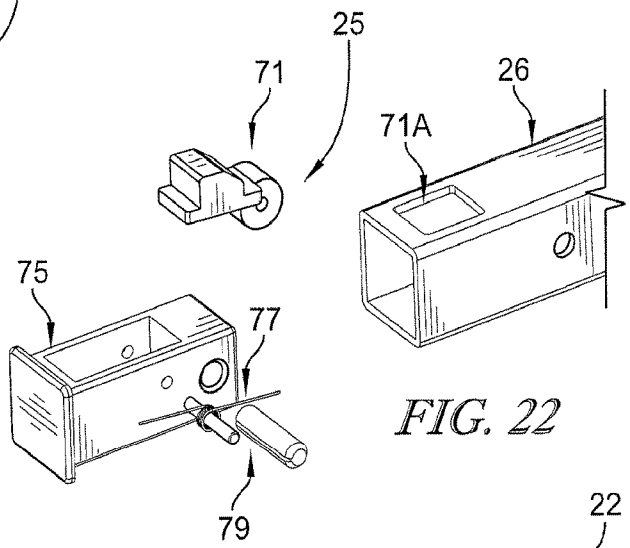
FIG. 22 is an enlarged exploded perspective assembly view of the segment lock.
Figure 23:
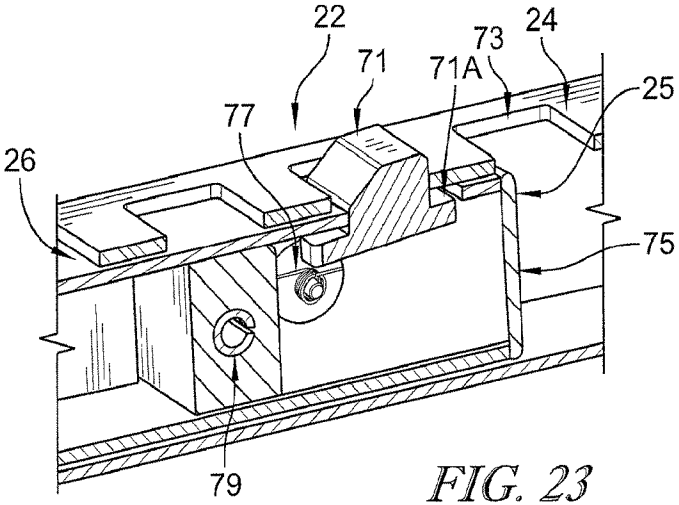
FIG. 23 is a sectional view taken along line 23-23 in FIG. 19.
Figures 24A, 24B, 24C:
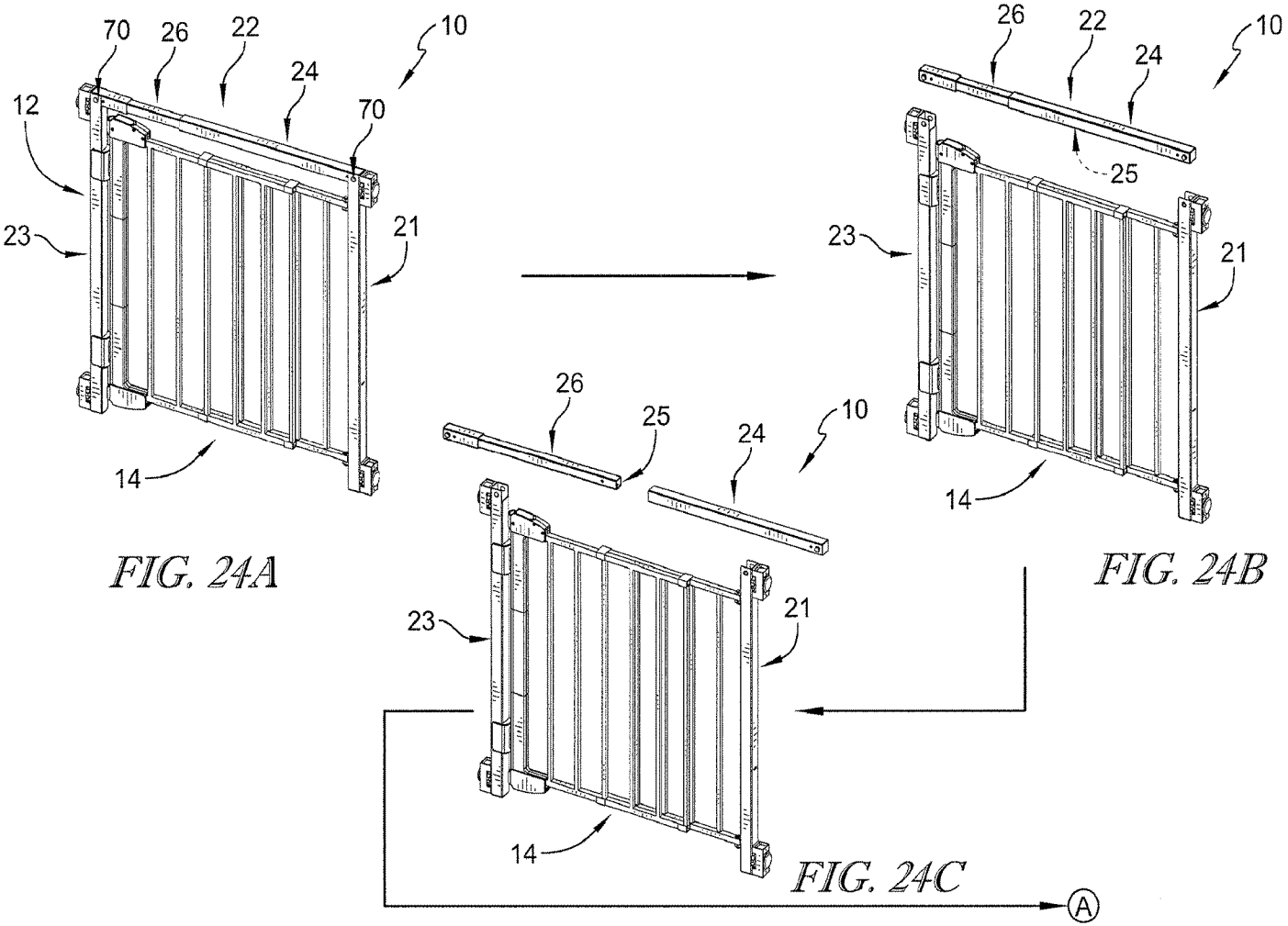
FIGS. 24A-E illustrate a multi-step process in accordance with the present disclosure for storing the segments of the removable threshold bar in the vertical side posts when the gate unit is in the hardware-mounted mode.
Figures 24D, 24E:
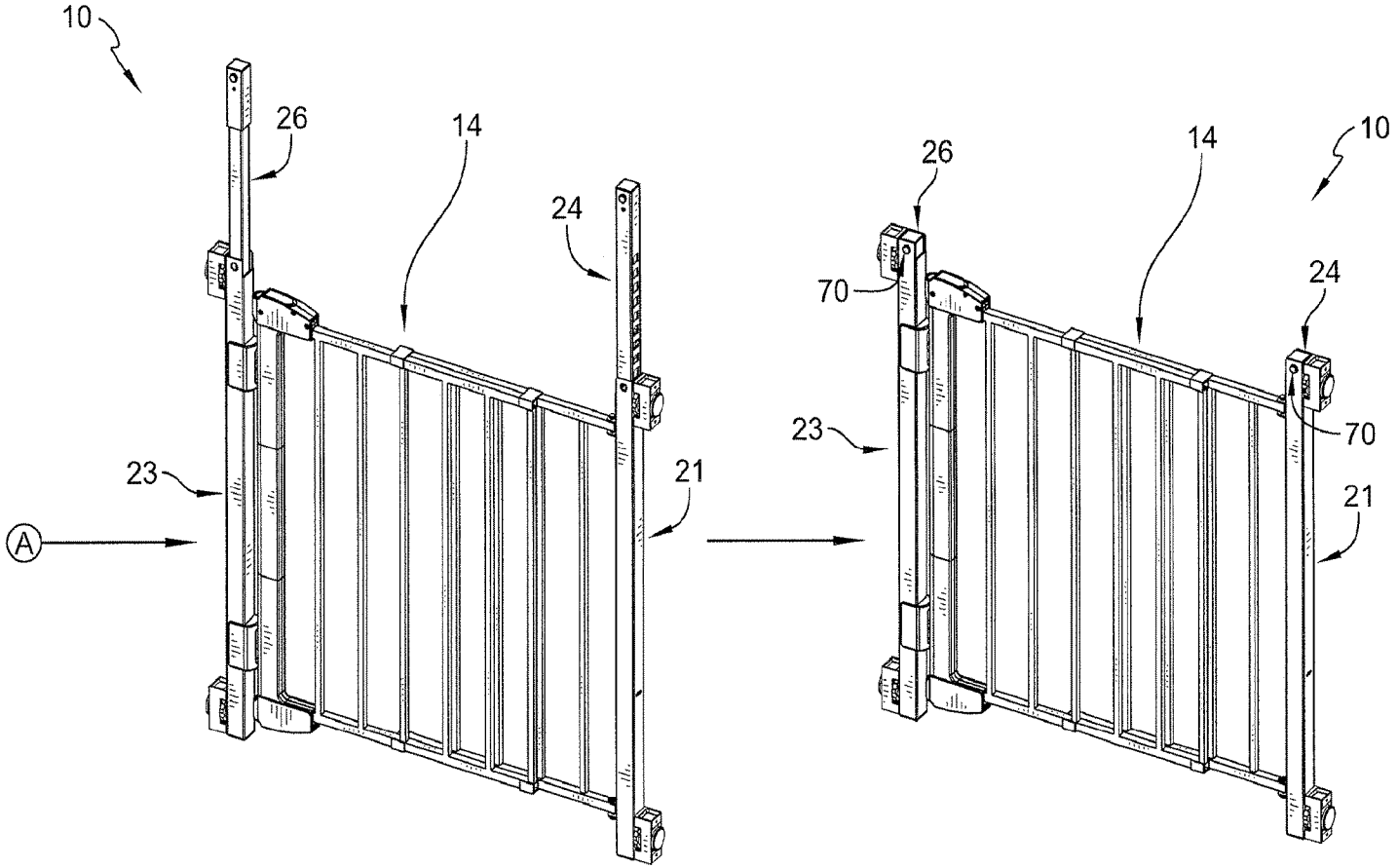

Bar segment lock 25 is coupled to bar segment 26 and includes a pawl 71 coupled to a housing 75 by a spring-pin assembly 77 as shown in FIGS. 22 and 23. Pawl 71 is pivotable relative to housing 75 and spring-pin assembly 77 biases pawl 71 toward an aperture 71A formed in bar segment 26. Housing 75 is coupled to segment 26 and secured by a retention pin 79.

Pawl 71 extends through apertures 73 in bar segment 24 to block movement of bar segment 24 relative to bar segment 26 at the selection of a user. Pawl 71 is sloped on a left side such that as bar segment 26 moves left pawl 71 is depressed when a left edge of aperture 73 engages the sloped portion of pawl 71. Conversely, pawl 71 is substantially vertical on a right side to engage with edges of apertures 73 to block movement of bar segment 26 to the right. A user depresses pawl 71 to release pawl 71 from engagement with edges of aperture 73 to allow bar segment 26 to move to the right relative to bar segment 24.

Removable threshold bar 22 is removable from the vertical side posts 21, 23 to clear a path through the gate unit 10 when in the hardware-mounted mode as suggested in FIGS. 24A-E. A user engages pinch locks 70 to release threshold bar 22 from vertical side posts 21, 23. Bar segments 24, 26 are separated from one another. Bar segment 24 is inserted into a first bar-segment storage space 215 formed in vertical side post 21 and bar segment 26 is inserted into a second bar-segment storage space 235 formed in vertical side post 23 as suggested in FIGS. 2B, 2C, and FIGS. 24C-24E. Pinch locks 70 engage with side posts 21, 23 to retain bar segments 24, 26 within side posts 21, 23.

Gate unit 10 is wrapped in packaging 30 for shipping and sale to users as suggested in FIGS. 25A-C. Packaging 30 includes perforated edges 34, 36, 38 to assist in installation of gate unit 10. For example, gate unit 10 is positioned within a doorway 102. A left side perforated edge 34 is removed. Packaging 30 maintains positioning of gate 14 relative to gate mount 12 as gate unit 10 is extended to match a width of doorway 102. Perforated edges 36 and 38 are removed to remove packaging 30 from gate unit 10 to complete the installation.

Figure 26:
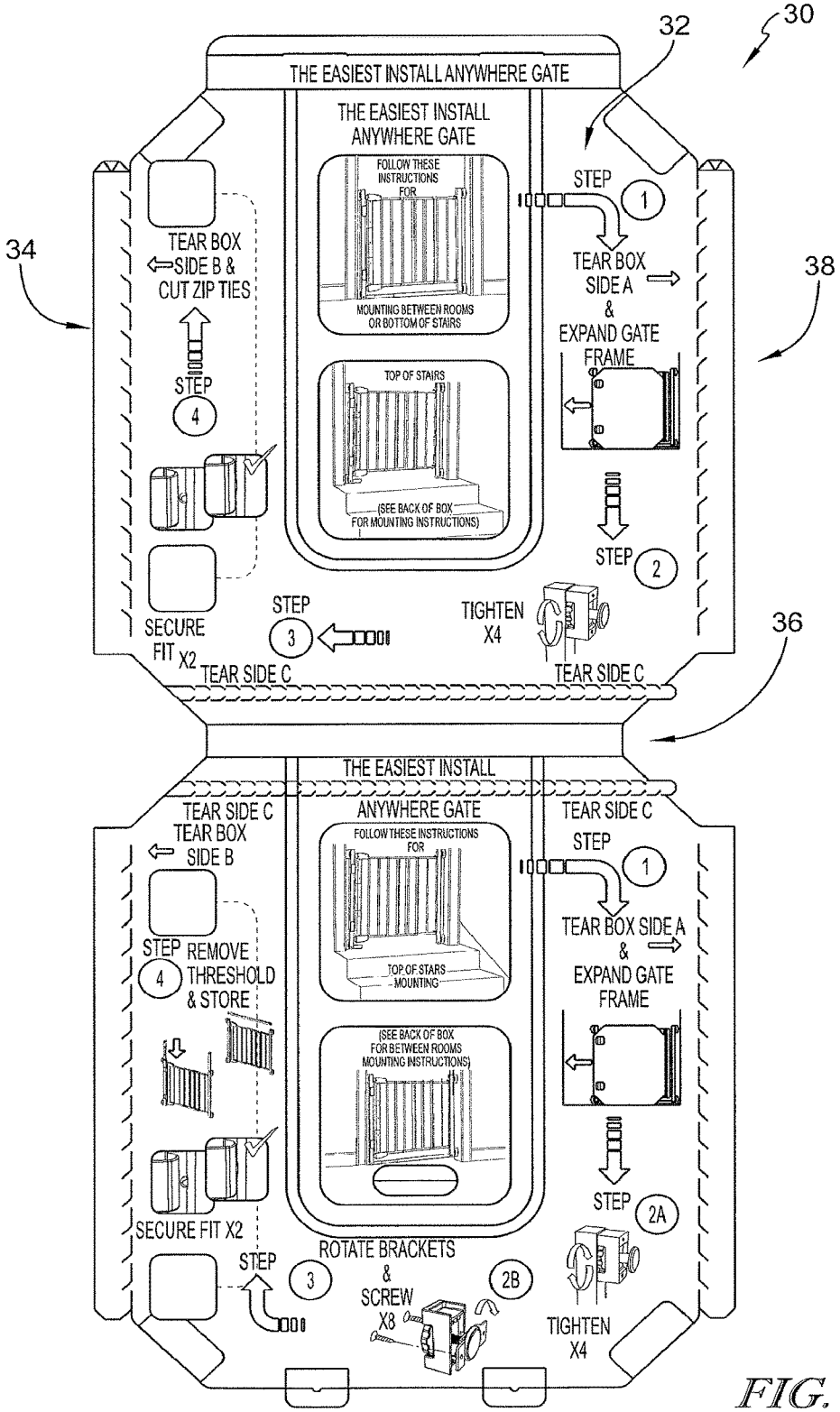
FIG. 26 is a plan view of packaging for use with the gate unit in accordance with the present disclosure showing that the packaging includes indicia illustrating how to install the gate unit in a doorway.
Figures 27A, 27B, 27C, 27D:
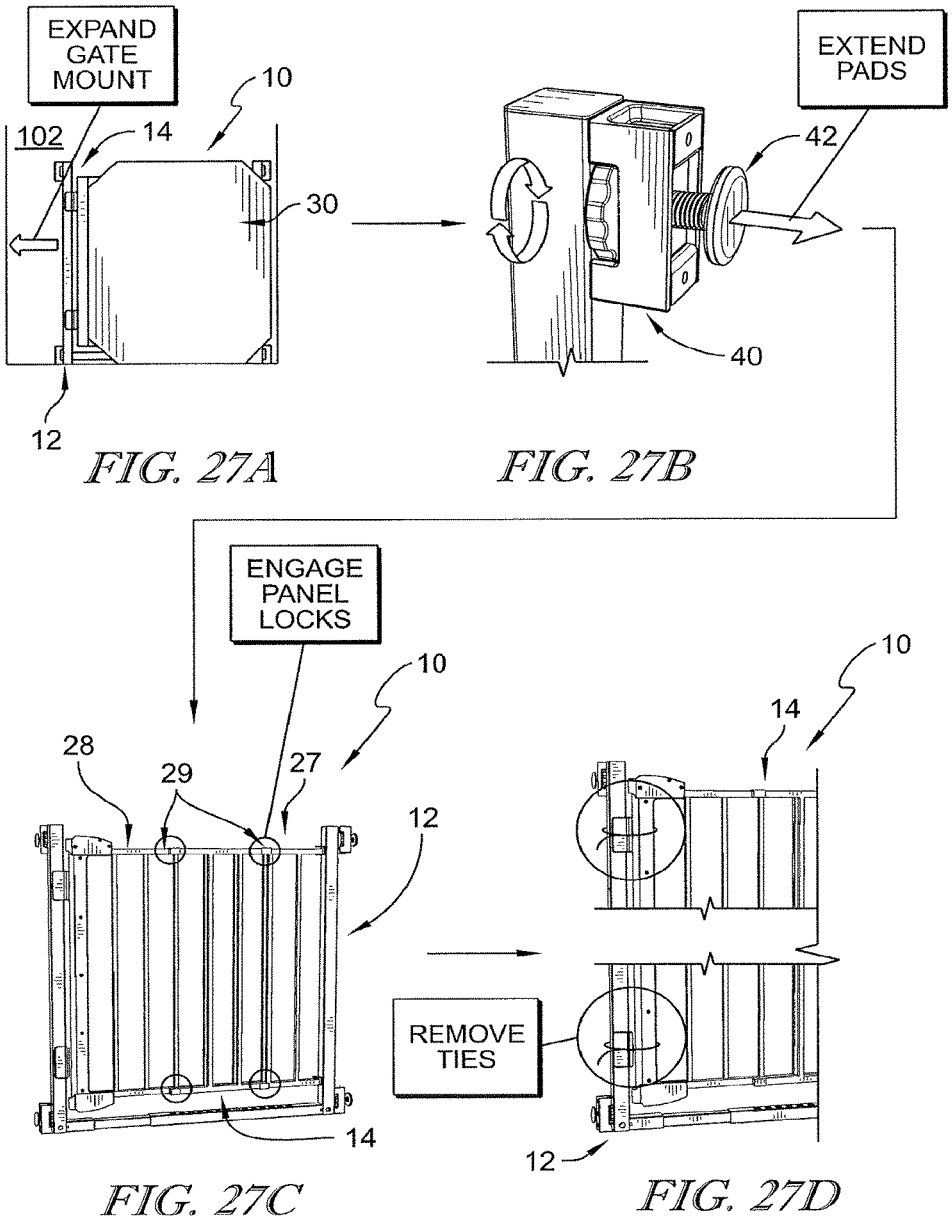
FIGS. 27A-D illustrate a method in accordance with the present disclosure for installing the gate unit in a doorway in the pressure-mounted mode shown, for example, in FIG. 1.
Figure 28A:
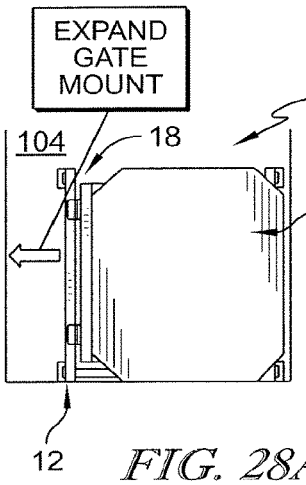
FIGS. 28A-J illustrate a method in accordance with the present disclosure for installing the gate unit in a gateway in the hardware-mounted mode as suggested, for example, in FIGS. 2A-2C.
Figure 28B:
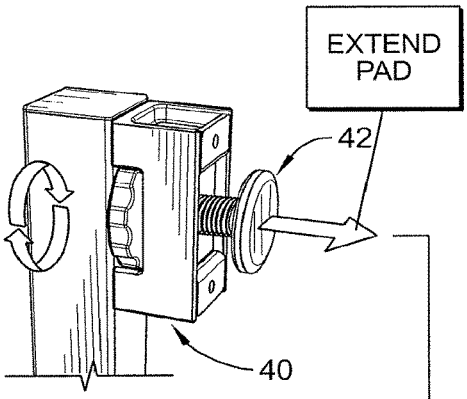
Figure 28C:
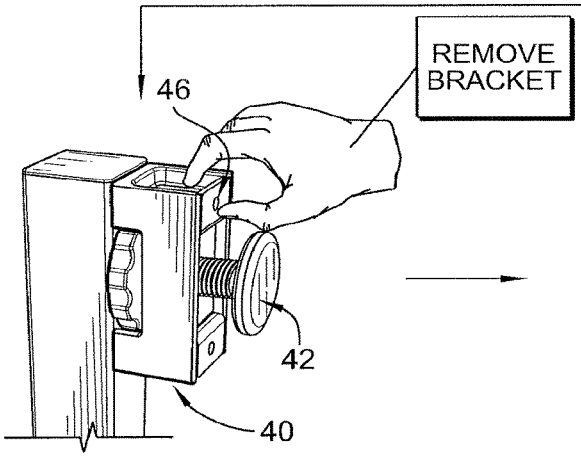
Figure 28D:
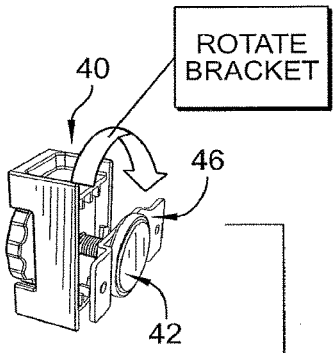
Figure 28E:
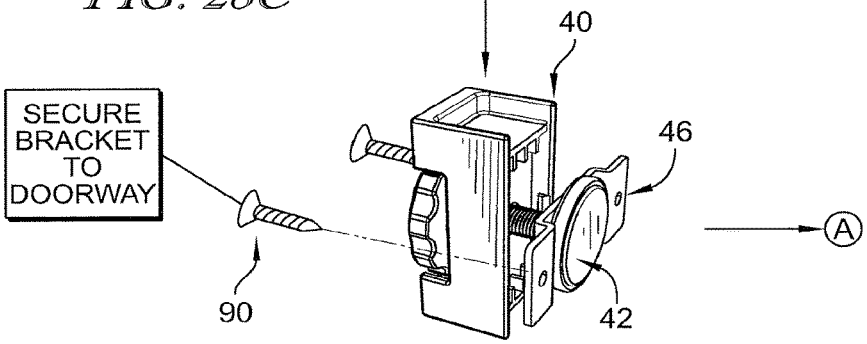
Figures 28F, 28G, 28H, 28I, 28J:
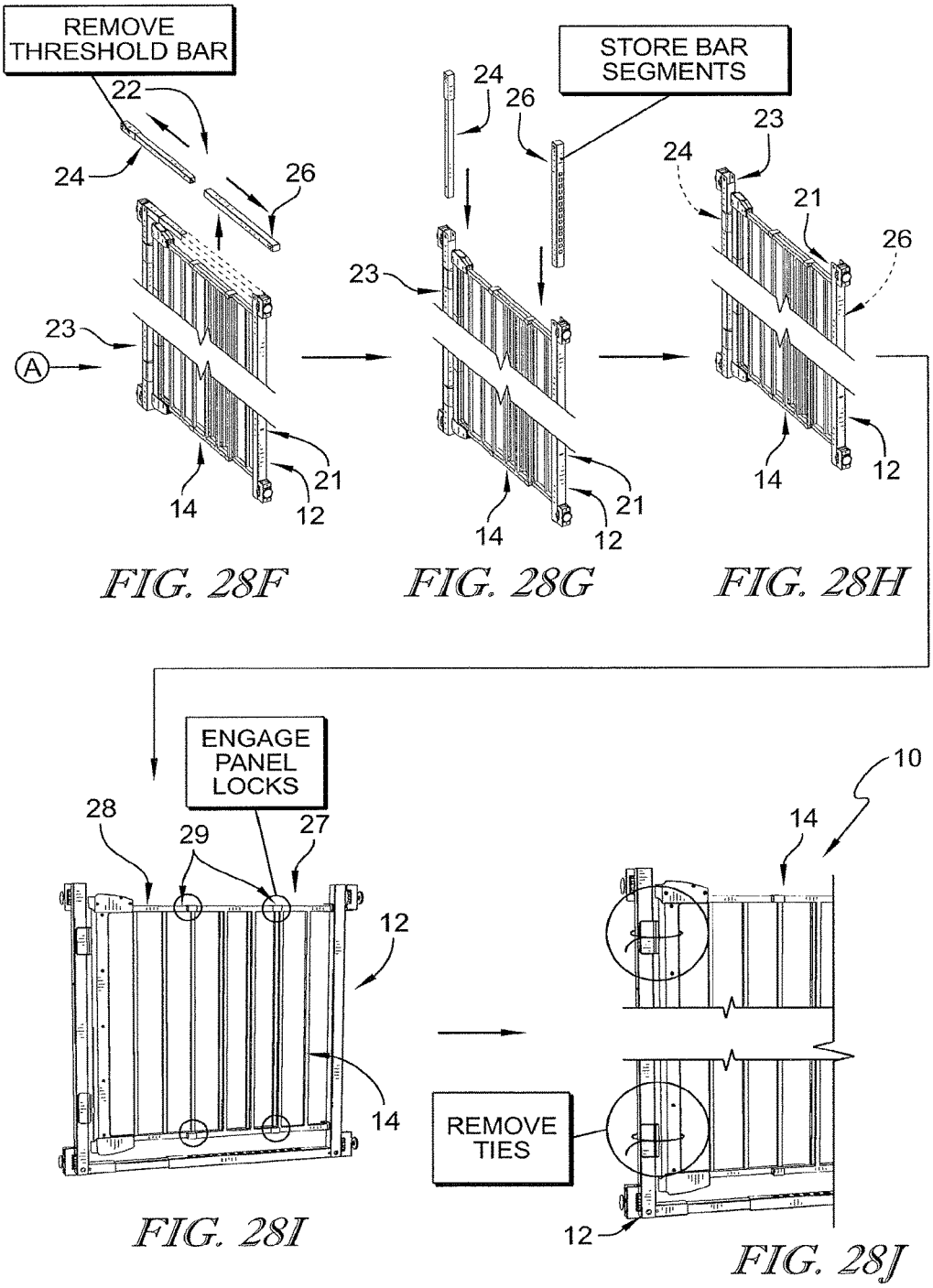

In the illustrative embodiment, packaging 30 includes indicia 32 including instructions on how to install gate unit 10 in either the pressure-mounted or hardware-mounted mode as suggested in FIG. 26. One side of packaging 30 includes instructions for installing gate unit 10 in the pressure-mounted mode and the other side includes instructions for installing gate unit 10 in the hardware-mounted mode. A user orients packaging 30 such that the selected installation mode instructions are facing toward them in a top-down readable position.

In one illustrative embodiment, to install gate unit 10 in the pressure-mounted mode, gate mount 12 and gate 14 are expanded within a doorway 102 in an interroom environment as suggested in FIGS. 27A-D. Pads 42 of retention feet 40 are extended to apply pressure against door jambs 105, 106 of a post-support frame associated with doorway 102. Panel locks 29 are engaged to maintain positioning of panels 27, 28 of gate 14. Zip ties holding gate 14 to gate mount 12 are removed to allow pivotable gate 14 to unlock and swing relative to gate mount 12.

In one illustrative embodiment, to install gate unit 10 in the hardware-mounted mode, gate mount 12 and gate 14 are expanded within a gateway 104 in a top-of-the-stairs environment as suggested in FIGS. 28A-J. Pads 42 of retention feet 40 are extended to allow bracket 46 to be moved. Bracket 46 is rotated and fasteners 90 are extended through bracket 46 to secure bracket 46 to a post-support frame associated with gateway 104. Threshold bar 22 is removed and stowed in bar-segment storage spaces 21S, 23S formed in vertical side rails 21, 23. Panel locks 29 are engaged to maintain positioning of panels 27, 28 of gate 14. Zip ties holding gate 14 to gate mount 12 are removed to allow pivotable gate 14 to unlock and swing relative to gate mount 12.

In accordance with the present disclosure, a dual-mode security gate unit 10 is configured to have the ability to convert from a pressure-mount configuration to a hardware-mount configuration. This allows a consumer to purchase one gate unit 10 and use it in any area of a house. In some embodiments, removal and storage of the threshold bar 22 in a gateway 104 in a top-of-the-stairs environment minimizes a trip obstacle. In some embodiments, packaging is used to instruct and aid in the installation process. A user chooses to pressure-mount OR hardware-mount the gate, and then they locate the correct side of the two-sided packaging and follow the appropriate instructions. The user will be able to place entire gate unit 10 (including the outer packaging/box) into the doorway 102 or gateway 104 and follow directions on outer package to install as pressure OR hardware mount without ever taking the gate back out of the doorway 102 or gateway 104.

The gate unit 10 includes left and right upright side posts 21, 23 connected to one another by a lower threshold bar 22 at the bottom. Threshold bar 22 includes two segments 24, 26 that telescope relative to one another. A ratchet feature is present that allows expanding adjustment but resists collapse unless actuated by the user. This adjustment allows the system to fit a variety of thruway sizes associated with various doorway and gateway widths. The gate unit 10 also includes an adjustable width gate 14 that is attached to and hinges from one upright. A handle and lock mechanism engages features on the opposing upright to lock the gate 14 in place.

Pressure pads are included in the four outermost corners of the gate unit 10 with threaded adjustment. Mounting brackets are integrated into storage areas at these positions and are deployed by the user for hardware mounting. To convert from pressure mount to hardware mount, the gate unit 10 is flipped 180° about a horizontal gate-inversion axis 12A, positioning the threshold bar 22 at the top above gate 14. After the mounting brackets are fastened to the wall, the threshold bar 22 is disengaged from the both left and right upright side posts 21, 23. The two telescoping bar segments 24, 26 are separated and stored inside the bar-segment storage spaces 215, 235 formed in the upright side posts 21, 23.

The threshold bar 22 is removable and storable. The gate unit 10 allows for both pressure and hardware mounting configurations while minimizing trip hazard in a gateway 104 in a top-of-the-stairs environment. The door hinge, door catch and lock, and gate system work in either configuration. The adjustable frame allows for use in a multitude of passage way widths without the need of additional pieces. The hardware mounting brackets are integrated and storable.

In illustrative embodiments, the gate unit 10 is configured to be varied in width at the option of a caregiver. The gate unit 10 also includes a gate mount 12 that is adapted to mate with a post-support frame bordering a doorway 102 or a gateway 104. The gate mount 12 is configured to support the gate 14 for pivotable movement about a gate-pivot axis 14A between a closed position closing a walkway passage formed in the gate mount 12 to block movement of a person through the walkway passage to an opened position opening the walkway passage to allow movement of a person through the walkway passage. A latch assembly is carried on the pivotable gate 14 and arranged to engage a latch receiver provided in the gate mount to lock the gate 14 in the closed position.

In illustrative embodiments, the gate mount 12 is U-shaped and is configured to be varied in width at the option of a caregiver to fit both narrow and relatively wider doorways 102 and gateways 104. The variable-width gate mount 12 includes an extensible and removable threshold bar 22 arranged to extend along the floor in the doorway 102, a first side post 21 arranged to extend upwardly from a first end of the extensible and removable threshold bar 22 to mate with a first vertical doorjamb 103 (or 106) included in the post-support frame, and a second side post 23 arranged to extend upwardly from a second end of the extensible threshold bar 22 to lie in spaced-apart relation to the first side post 21 and mate with a second vertical doorjamb 101 (or 105) included in the post-support frame.

In illustrative embodiments, the extensible and removable threshold bar 22 of the U-shaped gate mount 12 includes a first bar segment 24 coupled to the first side post 21 and a second bar segment 26 coupled to the second side post 23 and mounted to slide relative to the first bar segment 24 to vary the width of the gate mount 12 at the option of a consumer. The extensible and removable threshold bar 22 also includes a segment lock 25 mounted on the first bar segment 24 and configured to retain the second bar segment 26 in a selected stationary position relative to the first bar segment 24 at the option of a caregiver to establish and fix the width of the gate mount 12.

In illustrative embodiments, the gate 14 is configured to be varied in width at the option of a caregiver to match the width of the gate mount 12. The gate 14 includes a pivotable first panel 27 supported on a hinge included in the gate mount 12 and coupled to the first side post 21 for swinging movement about the gate-pivot axis 14A. The gate 14 also includes a slidable second panel 28 supported for lateral sliding movement relative to the pivotable first panel 27 to vary the width of the gate 14 at the option of a caregiver to match the narrow or wide width of the variable-width gate mount 12.

In illustrative embodiments, the extensible and removable threshold bar 22 included in the U-shaped gate mount 12 is positioned to lie below and under the first and second panels 27, 28 of the gate 14 when used in a pressure-mounted mode for mounting in a doorway 102 between rooms having a substantially even floor level or at the bottom of a staircase within a dwelling. The extensible and removable threshold bar 22 included in the U-shaped gate mount 12 that is positioned to lie above and over the first and second panels 27, 28 of the gate 14 when used in a hardware-mounted mode for mounting in a gateway 104 at the top of a staircase within a dwelling. The threshold bar 22 is removable from the side posts 21, 23 in the hardware-mounted mode to clear a path through the gate unit 10. The bar segments 24, 26 of the threshold bar 22 can be separated and then stowed within the bar-segment storage spaces 21S, 23S formed in side posts 21, 23 when the gate unit 10 is in the hardware-mounted mode in a gateway 104 in a top-of-the-stairs environment as suggested in FIGS. 2B, 2C, and 24.

In illustrative embodiments, the U-shaped gate mount 12 includes width compensators coupled to the first and second side posts 21, 23. The width compensators are configured to provide a lateral force against the post-support frame 101, 103 of a doorway 102 to form a pressure fit between the post-support frame 101, 103 of the doorway 102 and the U-shaped gate mount 12 to hold U-shaped gate mount 12 in place in the pressure-mounted mode. The width compensators are configured to be secured to the post-support frame of the gateway 104 to form hold U-shaped gate mount 12 in place in the hardware-mounted mode.

In illustrative embodiments, the latch assembly includes a pair of latches positioned to engage the latch receiver and a latch mover configured to bias the latches away from the latch receiver to unlock the gate. The latch mover includes a pair of handles and a latch retractor bar coupled between the handles. The latch retractor bar is positioned to engage the latches and moves in response to a caregiver pivoting one of the handles relative to the gate. The handle that is used depends on the mode of mounting the gate unit.

In illustrative embodiments, the latch assembly includes a latch base coupled to the gate 14 to support the latches. Each latch includes a pair of pins, a leaf spring coupled between the pins, and a lock tab coupled to the leaf spring. The pins ride in slots formed in the latch base and are biased toward one another by the leaf spring. The lock tab is positioned substantially at an apex of the leaf spring to extend into the latch receiver. The latch retractor bar of the latch mover engages the leaf spring to move the lock tab away from the latch receiver.

The invention claimed is:

1. A gate unit for use in a dwelling, the gate unit comprising a gate mount adapted to be mounted to a portion of the dwelling, a gate mounted on a portion of the gate mount for swinging movement about a gate-pivot axis between an opened position and a closed position, wherein the gate mount includes laterally spaced apart vertical side posts and a horizontally extending removable threshold bar that is coupled to the vertical side posts and arranged to interconnect first ends of each of the vertical side posts to provide the gate mount with a U-shape and the gate mount is adapted to be mounted to the portion of the dwelling in a pressure-mounted mode while the threshold bar remains coupled to the vertical side posts using pads that are held under pressure to the portion of the dwelling or in a hardware-mounted mode using hardware that is anchored to the portion of the dwelling after the threshold bar has been decoupled from the vertical side posts, wherein the gate mount is arranged to assume an upright orientation to cause the threshold bar to lie below the gate and along a floor underlying the gate when the gate unit is placed in a doorway in an interroom environment in the pressure-mounted mode and is arranged to assume an inverted orientation to cause the threshold bar to lie above the gate and in spaced-apart relation to the floor underlying the gate to position the gate to lie between the threshold bar and the floor when the gate unit is placed in a gateway associated with a staircase in a top-of-the-stairs environment, and wherein the gate mount further includes bar-removal means for coupling and uncoupling the threshold bar to and from the vertical side posts so that the gate mount is retained in the upright orientation in the doorway in the interroom environment in the pressure-mounted mode while the threshold bar is coupled to the vertical side posts and arranged to extend along the floor and the gate mount is retained in the inverted orientation in the gateway in the top-of-the-stairs environment in the hardware-mounted mode before and after decoupling of the threshold bar from the vertical side posts.

2. The gate unit of claim 1, wherein the threshold bar includes a first segment, a second segment mounted for movement relative to the first segment and to be separated from the first segment, and a segment lock configured to block relative movement of the first and second segments, the first vertical side post is formed to include a first bar-segment storage space sized to receive therein the first segment after the threshold bar has been decoupled from the vertical side posts and the first segment has been separated from the second segment, the second vertical side post is formed to include a second bar-segment storage space sized to receive therein the second segment after the threshold bar has been decoupled from the vertical side posts and the first segment has been separated from the second segment, the first segment is arranged to lie in the bar-storage space formed in the first vertical side post and the second segment is arranged to lie in the bar-storage space formed in the second vertical side post when the gate mount is retained in the inverted orientation in the gateway in the top-of-the-stairs environment.

3. The gate unit of claim 2, wherein the first bar-segment storage space is formed in an interior region of the first vertical side post and the second bar-segment storage space is formed in an interior region of the second vertical side post.

4. The gate unit of claim 1, further comprising a latch receiver coupled to a second of the vertical side posts and arranged to extend toward the gate upon movement of the gate to the closed position and wherein the latch assembly includes a latch arranged to swing with the gate about the gate-pivot axis relative to the latch receiver, and wherein the latch includes a lock tab that is arranged to extend into a tab-receiving recess formed in the latch receiver to block swinging movement of the gate about the gate-pivot axis relative to the second of the vertical side posts when the gate occupies the closed position and the latch further includes a leaf spring coupled to the lock tab and configured yieldably to urge the lock tab into the tab-receiving recess formed in the latch receiver upon arrival of the gate at the closed position.

5. The gate unit of claim 4, wherein the leaf spring is C-shaped and includes a convex side coupled to the lock tab and an opposite concave side arranged to face away from the lock tab toward the gate.

6. The gate unit of claim 4, wherein the leaf spring includes a first curved leg having a lower end coupled to the lock tab and an opposite upper end confined to slide in an upward direction during withdrawal of the lock tab from the tab-receiving recess formed in the latch receiver and a second curved leg having an upper end coupled to the lock tab and an opposite lower end confined to slide in a downward direction in a direction away from the opposite upper end of the first curved leg during withdrawal of the lock tab from the tab-receiving recess formed in the latch receiver.

7. The gate unit of claim 6, further comprising a latch-retractor bar constrained to move relative to the second of the vertical side posts to engage the leaf spring to increase a distance between the opposite upper end of the first curved leg and the opposite lower end of the second curved leg to reduce a lateral height of the leaf spring to retract the lock tab laterally from the tab-receiving recess formed in the latch receiver.

8. The gate unit of claim 4, wherein the leaf spring includes an upper end constrained to move in an upper vertical slot formed in a latch base coupled to the gate to swing with the gate, a lower end constrained to move in a lower vertical slot formed in the latch base to lie between the upper vertical slot and a floor underlying the gate, and a middle portion arranged to lie between the upper and lower ends and coupled to the lock tab.

9. The gate unit of claim 8, wherein the leaf spring is C-shaped and includes a convex side coupled to the lock tab and an opposite concave side arranged to face away from the lock tab toward the gate.

10. The gate unit of claim 9, further comprising a latch-retractor bar constrained to move relative to the second of the vertical side posts to engage the convex side of the leaf spring to move the latch from a locked position in which the lock tab extends into the tab-receiving recess formed in the latch receiver when the gate occupies the closed position to an unlocked position wherein the lock tab of the latch is withdrawn from the tab-receiving recess formed in the latch receiver and clear of the latch receiver so as to increase a distance between the upper and lower ends of the leaf spring.

11. The gate unit of claim 4, further comprising a latch-retractor bar constrained to move relative to the second of the vertical side posts to engage the leaf spring to move the latch relative to the latch receiver to withdraw the lock tab of the latch from the tab-receiving recess formed in the latch receiver and clear of the latch receiver to free the gate to swing about the gate-pivot axis relative to the latch receiver from the closed position to the opened position.

12. The gate unit of claim 11, wherein the threshold bar includes a first segment, a second segment mounted for movement relative to the first segment and to be separated from the first segment, and a segment lock configured to block relative movement of the first and second segments, the first of the vertical side posts is formed to include a first bar-segment storage space sized to receive therein the first segment after the threshold bar has been decoupled from the vertical side posts and the first segment has been separated from the second segment, a second of the vertical side posts is formed to include a second bar-segment storage space sized to receive therein the second segment after the threshold bar has been decoupled from the vertical side posts and the first segment has been separated from the second segment, the first segment is arranged to lie in the bar-storage space formed in the first of the vertical side posts and the second segment is arranged to lie in the bar-storage space formed in the second of the vertical side posts when the gate mount is retained in the inverted orientation in the gateway in the top-of-the-stairs environment.

13. The gate unit of claim 12, wherein the latch-retractor bar is positioned to lie between the second of the vertical side posts and the gate when the gate occupies the closed position.

14. The gate unit of claim 1, wherein the variable-width gate mount further includes a retention foot coupled to one of the vertical side posts and adapted to engage an opposing portion of the post-support frame and wherein the retention foot comprises a knob retainer coupled to said one of the vertical side posts to form a knob-receiving space and a shaft-receiving aperture communicating with the knob-receiving space, a threaded shaft formed to include opposite inner and outer ends arranged to extend through the shaft-receiving aperture to locate the inner end of the threaded shaft in the knob-receiving space and the outer end of the threaded shaft outside of the knob-receiving space, an engagement pad coupled to the outer end of the threaded shaft to rotate therewith about an axis of rotation extending along the length of the threaded shaft, a rotatable nut located in the knob-receiving space and engaged to the threaded shaft, and a knob located in the knob-receiving space and coupled to the rotatable nut to rotate the rotatable nut about the axis of rotation to cause the engagement pad to move axially along the axis of rotation to engage or disengage the opposing portion of the post-support frame.

15. The gate unit of claim 14, wherein the knob retainer comprises a coupler arranged to engage said one of the vertical side posts and formed to include the knob-receiving space, a housing arranged to surround and cover the coupler and engaged to the coupler, a bracket arranged to lie between the housing and the engagement pad, and portions of the bracket, housing, and coupler are formed to cooperate to define the shaft-receiving aperture.

16. A gate unit comprising an extensible gate adapted to be widened or narrowed to block openings of various widths, the extensible gate including a first panel and a slidable second panel supported for lateral sliding movement relative to the first panel to vary the width of the extensible gate, a variable-width gate mount adapted to mate with a post-support frame bordering a doorway or a gateway, the variable-width gate mount including an extensible threshold bar, a first vertical side post arranged to extend upwardly from a first end of the extensible threshold bar and to carry a hinge to support the extensible gate for pivotable movement relative to the variable-width gate mount between opened and closed positions, and a second vertical side post arranged to extend upwardly from a second end of the extensible threshold bar to lie in spaced-apart relation to the first vertical side post, and a latch assembly carried on the extensible gate and adapted to mate with the second vertical side post to retain the extensible gate in the closed position, wherein the variable-width gate mount is configured to provide means for mounting the gate unit in a first mode where pressure is exerted by the variable-width gate mount against the post-support frame to maintain positioning of the gate unit within the doorway and in a second mode where the variable-width gate mount is secured to the post-support frame and the extensible threshold bar is removed to maintain positioning of the gate unit within the doorway or gateway.

17. The gate unit of claim 16, wherein the extensible threshold bar includes a first segment associated with the first vertical side post, a second segment associated with the second vertical side post and mounted to slide relative to the first segment to vary the width of the variable-width gate mount, and a segment lock mounted on the first segment and arranged to engage the second segment to retain in a selected stationary position relative to the first segment when used by a caregiver to establish and fix the width of the variable-width gate mount.

18. The gate unit of claim 17, wherein the first segment is stowable in one of the first and second vertical side posts and the second segment is stowable in the other of the first and second vertical side posts.

19. The gate unit of claim 16, further comprising a latch receiver coupled to the second vertical side post and arranged to extend toward the gate upon movement of the gate to the closed position and wherein the latch assembly includes a latch arranged to swing with the gate about the gate-pivot axis relative to the latch receiver, and wherein the latch includes a lock tab that is arranged to extend into a tab-receiving recess formed in the latch receiver to block swinging movement of the gate about the gate-pivot axis relative to the second vertical side post when the gate occupies the closed position and the latch further includes a leaf spring coupled to the lock tab and configured yieldably to urge the lock tab into the tab-receiving recess formed in the latch receiver upon arrival of the gate at the closed position.

20. The gate unit of claim 19, wherein the leaf spring is C-shaped and includes a convex side coupled to the lock tab and an opposite concave side arranged to face away from the lock tab toward the gate.

21. The gate unit of claim 19, wherein the leaf spring includes a first curved leg having a lower end coupled to the lock tab and an opposite upper end confined to slide in an upward direction during withdrawal of the lock tab from the tab-receiving recess formed in the latch receiver and a second curved leg having an upper end coupled to the lock tab and an opposite lower end confined to slide in a downward direction in a direction away from the opposite upper end of the first curved leg during withdrawal of the lock tab from the tab-receiving recess formed in the latch receiver.

22. The gate unit of claim 21, further comprising a latch-retractor bar constrained to move relative to the second vertical side post to engage the leaf spring to increase a distance between the opposite upper end of the first curved leg and the opposite lower end of the second curved leg to reduce a lateral height of the leaf spring to retract the lock tab laterally from the tab-receiving recess formed in the latch receiver.

23. The gate unit of claim 19, wherein the leaf spring includes an upper end constrained to move in an upper vertical slot formed in a latch base coupled to the gate to swing with the gate, a lower end constrained to move in a lower vertical slot formed in the latch base to lie between the upper vertical slot and a floor underlying the gate, and a middle portion arranged to lie between the upper and lower ends and coupled to the lock tab.

24. The gate unit of claim 23, wherein the leaf spring is C-shaped and includes a convex side coupled to the lock tab and an opposite concave side arranged to face away from the lock tab toward the gate.

25. The gate unit of claim 24, further comprising a latch-retractor bar constrained to move relative to the second vertical side post to engage the convex side of the leaf spring to move the latch from a locked position in which the lock tab extends into the tab-receiving recess formed in the latch receiver when the gate occupies the closed position to an unlocked position wherein the lock tab of the latch is withdrawn from the tab-receiving recess formed in the latch receiver and clear of the latch receiver so as to increase a distance between the upper and lower ends of the leaf spring.

26. The gate unit of claim 19, further comprising a latch-retractor bar constrained to move relative to the second vertical side post to engage the leaf spring to move the latch relative to the latch receiver to withdraw the lock tab of the latch from the tab-receiving recess formed in the latch receiver and clear of the latch receiver to free the gate to swing about the gate-pivot axis relative to the latch receiver from the closed position to the opened position.

27. The gate unit of claim 26, wherein the extensible threshold bar includes a first segment, a second segment mounted for movement relative to the first segment and to be separated from the first segment, and a segment lock configured to block relative movement of the first and second segments, the first vertical side post is formed to include a first bar-segment storage space sized to receive therein the first segment after the extensible threshold bar has been decoupled from the vertical side posts and the first segment has been separated from the second segment, the second vertical side post is formed to include a second bar-segment storage space sized to receive therein the second segment after the extensible threshold bar has been decoupled from the vertical side posts and the first segment has been separated from the second segment, the first segment is arranged to lie in the bar-storage space formed in the first vertical side post and the second segment is arranged to lie in the bar-storage space formed in the second vertical side post when the gate mount is retained in the inverted orientation in the gateway in the top-of-the-stairs environment.

28. The gate unit of claim 27, wherein the latch-retractor bar is positioned to lie between the second vertical side post and the gate when the gate occupies the closed position.

29. The gate unit of claim 16, wherein the variable-width gate mount further includes a retention foot coupled to one of the first and second vertical side posts and adapted to engage an opposing portion of the post-support frame and wherein the retention foot comprises a knob retainer coupled to said one of the first and second vertical side posts to form a knob-receiving space and a shaft-receiving aperture communicating with the knob-receiving space, a threaded shaft formed to include opposite inner and outer ends arranged to extend through the shaft-receiving aperture to locate the inner end of the threaded shaft in the knob-receiving space and the outer end of the threaded shaft outside of the knob-receiving space, an engagement pad coupled to the outer end of the threaded shaft to rotate therewith about an axis of rotation extending along the length of the threaded shaft, a rotatable nut located in the knob-receiving space and engaged to the threaded shaft, and a knob located in the knob-receiving space and coupled to the rotatable nut to rotate the rotatable nut about the axis of rotation to cause the engagement pad to move axially along the axis of rotation to engage or disengage the opposing portion of the post-support frame.

30. The gate unit of claim 29, wherein the knob retainer comprises a coupler arranged to engage said one of the first and second vertical side posts and formed to include the knob-receiving space, a housing arranged to surround and cover the coupler and engaged to the coupler, a bracket arranged to lie between the housing and the engagement pad, and portions of the bracket, housing, and coupler are formed to cooperate to define the shaft-receiving aperture.

* * * * *